US010231486B2

(12) United States Patent
Bowen et al.

(10) Patent No.: US 10,231,486 B2
(45) Date of Patent: Mar. 19, 2019

(54) VAPORIZATION DEVICE HAVING INTEGRATED GAMES

(71) Applicant: PAX LABS, INC., San Francisco, CA (US)

(72) Inventors: Adam Bowen, San Francisco, CA (US); Nicholas J. Hatton, San Francisco, CA (US)

(73) Assignee: PAX Labs, Inc., San Francisco, CA (US)

( * ) Notice: Subject to any disclaimer, the term of this patent is extended or adjusted under 35 U.S.C. 154(b) by 0 days.

(21) Appl. No.: 15/456,446

(22) Filed: Mar. 10, 2017

(65) Prior Publication Data

US 2017/0259170 A1 Sep. 14, 2017

Related U.S. Application Data

(60) Provisional application No. 62/306,551, filed on Mar. 10, 2016.

(51) Int. Cl.

| | |
|---|---|
| ***A24F 47/00*** | (2006.01) |
| ***A63F 9/00*** | (2006.01) |
| ***A63F 9/24*** | (2006.01) |

(52) U.S. Cl.

CPC ..... *A24F 47/008* (2013.01); *A24F 47/00* (2013.01); *A63F 9/001* (2013.01); *A63F 9/24* (2013.01); *A63F 2009/0049* (2013.01); *A63F 2009/0063* (2013.01); *A63F 2009/2454* (2013.01); *A63F 2009/2477* (2013.01); *A63F 2009/2485* (2013.01); *A63F 2009/2488* (2013.01); *A63F 2300/8094* (2013.01)

(58) Field of Classification Search

CPC ..... A24F 47/00; A24F 47/008; A63F 9/001; A63F 9/24; A63F 2009/0049; A63F 2009/0063; A63F 2009/2454; A63F 2009/2477; A63F 2009/2485; A63F 2009/2488; A63F 2300/8094

See application file for complete search history.

(56) References Cited

U.S. PATENT DOCUMENTS 5,855,513 A * 1/1999 Lam ..... A63F 3/00643 273/237
2013/0340775 A1* 12/2013 Juster ..... H04L 67/42 131/273

(Continued)

*Primary Examiner* — Corbett B Coburn
(74) *Attorney, Agent, or Firm* — Mintz Levin Cohn Ferris Glovsky and Popeo, P.C.

(57) ABSTRACT

A vaporization device that includes an entertainment mode or modes including one or more game modes. The vaporization device may enhance the user experience. The entertainment mode may be engaged by a sequence of predetermined manipulations of the vaporization device. The entertainment mode may include one or more interactive games using the device, and/or one or more display modes. The interactive games may include a pattern-following game, a memory game, a triggered output game, or a chance game. The entertainment mode may also include games that may be played by one or more persons. The entertainment mode may modify the operation (e.g., heater control, appearance, user interface, etc.) of the device while still permitting the vaporization of vaporizable material.

10 Claims, 16 Drawing Sheets

(56) References Cited

U.S. PATENT DOCUMENTS

| | | | | |
|---|---|---|---|---|
| 2014/0194172 | A1* | 7/2014 | Klitsner | A63F 9/24 463/7 |
| 2015/0181945 | A1* | 7/2015 | Tremblay | A24F 47/008 131/328 |
| 2016/0106936 | A1* | 4/2016 | Kimmel | A24F 47/008 128/202.21 |
| 2016/0158782 | A1* | 6/2016 | Henry, Jr. | B05B 12/08 700/275 |
| 2016/0331025 | A1* | 11/2016 | Cameron | A24F 47/002 |
| 2017/0006917 | A1* | 1/2017 | Alvarez | A24F 47/008 |
| 2017/0020188 | A1* | 1/2017 | Cameron | H04L 67/025 |
| 2017/0181467 | A1* | 6/2017 | Cameron | A63F 13/90 |
| 2017/0185364 | A1* | 6/2017 | Cameron | G06F 3/1446 |
| 2017/0235918 | A1* | 8/2017 | Hagen | G06F 19/3456 705/2 |
| 2018/0077967 | A1* | 3/2018 | Hatton | A61M 11/042 |

* cited by examiner

Entertainment Mode Games and Displays

| Name | Effect |
|---|---|
| "Party Mode 1" Interactive game | Change the color(s) of petals (LEDs): Purple Plasma when Heating, Rainbow Plasma when Regulating, Cool Blue Wave when in Motion Standby. Plasma speeds up with Lip Presence. Plasma loops every 30-60s, but the loop is different every time plasma starts after device state change or device turn on.<br>Plasma refers to change in intensity of LED (e.g., sinusoidal change) |
| "Color Pop" Interactive game | Every time device moves or when Lip Sensing detects contact (checked 250 times per second), one of the petals (LEDs) changes to a random color. Heating/Regulating/Motion Standby are not indicated.<br>This mode can be used to show what trips lip sensing. |
| "Awemeter" Interactive game | Device shows approximate velocity on all petals. X-axis (side to side) is blue. Y-axis (through center of tube) is green. Z-axis is red.<br>When device isn't moving, LEDs are dark purple for Heating, dark green for Regulating, and dark blue for Motion Standby.<br>Oven can be turned off in this and subsequent Party Modes. Enter Temp Set mode and cycle through temps until all petals turn blue |
| "Tilt-o-Whirl" Interactive game | Plasma between colors based on max accelerations seen recently. These colors drift towards the current tilt (acceleration) seen, so when the device sits still, the LEDs all settle on one color based on the device's tilt.<br>Heating/Regulating/Motion Standby are not indicated.<br>The idea behind this party mode is that it drifts on one color when it's been sitting still for a while, and shaking the device whips up a storm of color that dies down gradually. |
| "Simon" Memory game Interactive game | Device blinks white three times when you've entered this mode, then the game starts. A round in the game consists of the device lighting up three or more petals (one at a time) in a random order, after which the user must reproduce that order by holding the device level with the ground (lights facing up) and then tilting the device so that the petal they want to light goes down (it's as if you're pushing down on the petal you want to light). LEDs pulse white if the user does this correctly. LEDs pulse red after the first incorrect entry. The game starts with a series of random series of three petals (Level 3). A petal is added to the pattern every time the user correctly reproduces the series generated by the device.<br>After the user beats Level 20, they unlock music (e.g., "Funky Town"). The device plays the first four bars of the melody when the user beats Level 20 and every time the device is turned on after unlocking music. After the user beats Level 40 (max level for the game), the device permanently changes the colors of the game to fuchsia, mint, sky blue, and hot pink from the original red, yellow, green, and blue.<br>Heating/Regulating/Motion Standby are not indicated.<br>Oven is automatically turned off when the mode is entered to save battery and preserve oven contents. Oven can be turned back on by going into Temp Set Mode. Oven is automatically turned on when this mode is exited.<br>Once unlocked, music/tone on startup can be toggled on and off by entering temp set and pressing the temp set button five times quickly (within a second). Device will blink all four Simon colors three times to indicate music was toggled.<br>Rolling the device three times in this mode loops back to "Party Mode 1". |
| "Knight Rider" Display | A pulse travels left to right and back in most orientations like KITT's scanner in the TV series Knight Rider. Pulse is red when Heating, green when Regulating, and blue when in Motion Standby.<br>This is a somewhat hidden display in entertainment mode. To get into this display, the device must be rolled three times in one direction and then three times in the opposite direction before the device is taken out of its horizontal orientation |

FIG. 10

Device State Indicators

| Device State | LED indication | Note |
|---|---|---|
| Heating | Purple Heat Wave | Purple wave always travels up (opposite gravity) for all device orientations |
| Regulating (at set temperature) | Green Plasma | LEDs move together asynchronously through warm and cool greens |
| Motion Standby | Cool Blue Wave | Blue wave always travels down (towards the ground) for all device orientations |
| Temp Set | 1-4 Warm Petals Lit | Number of petals lit indicates temperature setting. Color shifts from yellow with one petal (coolest setting) to red with four petals (hottest setting) |
| Charging | White Petals Lit/Pulsing | Number of petals lit indicates state of charge in 25% increments. Two petals fully lit with two petals pulsing indicates 50-75% state of charge. Four petals fully lit means 100% state of charge |

FIG. 11A

User Interactions

| Event | User Action | Device Indication | Device Action Detail |
|---|---|---|---|
| Turn On | Short Button Press when Device is Off | White Windup into Heating or Regulating depending on current Oven Temp | |
| Turn Off | Short Button Press when Device is Heating or Regulating | LEDs turn off | Device won't turn off with button press in temp set |
| Up to Temp | None. Device has reached Active Set Point | Transition to Regulating | Device will take longer to heat to higher temp settings or with low battery. |
| Enter Temp Set | Hold Button for 1 second when Device is Heating or Regulating | Transition to 1-4 petals lit yellow, orange, or red | |
| Change Temp Setting | Short Button Press when Device is in Temp Set | Number of petals lit increments, cycles back to 1 petal from 4 petals | This sets the Base Set Point to 199°C (390°F), 211°C (412°F), 223°C (433°F), or 235°C (455°F). Lip Sensing can reduce the Active Set Point up to 15°C (27°F) below the Base Set Point |
| Exit Temp Set | Hold Button for 1 second or Shake when Device is in Temp Set | Transitions to Heating or Regulating | |
| Battery Indication | Shake while Device is Heating or Regulating | 1-4 white petals illuminate | 1 petal: 0-25% charge, 2 petals: 25-50%, 3 petals: 50-75% charge, 4 petals: 75-100% |
| Motion Standby Entry | Let device sit still for 30s when Regulating (60s in Party Mode) | Transition to Motion Standby | Oven temp drops to the Standby Set Point, 160°C (320°F) |
| Motion Standby Exit | Move Device or Draw on Device when in Motion Standby | Transition to Heating or Regulating | Lip Presence or Motion exits Standby, resets Motion Standby timer. Oven heats back up to Active Set Pt. |
| Motion Sleep | Let device sit still for 3min after Device started Regulating (hit set temperature) | LEDs turn off | "Sleep" is the same as "Off" |
| Lip Sense Cooling | No Lip (or Finger) Sensed for 20s (30s in Party Mode) when Regulating | No indication | Active Set Point decreases 5°C (9°F) every 20s (30s in Party Mode) no lip is detected. Max 15°C (27°F) cooling from this feature. |
| Lip Sense Boost | Place Lip or Finger on Mouthpiece | Plasma speeds up slightly (this is a subtle effect that the user shouldn't have to look for) | Active Set Point is reset to the Base Set Point. Heater goes full power until lip/finger is removed or until Oven Temp is 5°C (9°F) above Base Set Point. Lip Sense Cooling timer is reset. |
| Lip Sense Sleep | No Lip (or Finger) Sensed for 3min after Device started Regulating (hit set temperature) | LEDs turn off | "Sleep" is the same as "Off" |
| Charge Device | Place Device on Charge Cradle with USB or AC Adapter connected | Transition to Charge State (one or more petals pulsing if device is charging, all petals fully lit if device is fully charged) | |
| Enter/Next Party Mode | Roll Device Three Times in Horizontal Orientation | Various (detailed below) | In Party Mode, Motion Standby is entered after 60s of device not moving (instead of 30s) when Regulating; Lip Sense Cooling happens every 30s (instead of 20s) |
| Fully Discharged Battery | Use Device until battery is fully discharged or turn Device on after battery has been fully discharged | LEDs blink red three times and then turn off | Pressing the button five times while device is blinking red will make the device blink white once for every hundred hours the device has been in use |

FIG. 11B

Error Indicators

| Error | Overview | Indication |
|---|---|---|
| Oven Overtemp | Oven was measured 20 °C above the max temperature setting for the device | 10 red blinks and shutoff |
| Temp Sensor Fault | Temperature Sensor is disconnected or broken | 10 blue blinks and shutoff |
| Heater Switch Fault | Heater can't be turned on and off normally | 10 mint blinks and shutoff |
| Heater Timeout | Device took over two minutes to heat up, indicate abnormal heating or temp sensing | 10 orange blinks and shutoff |
| Battery Measurement Fault | Battery voltage measurement circuit not working normally | 10 yellow blinks and shutoff |
| PCB Overtemp | PCB is too hot to run safely. Device could be too well insulated, or there is a board level issue | 10 pink blinks and shutoff |
| Motion Sensor Fault | Motion Sensor not working normally | 10 purple blinks and shutoff |
| Charge Timeout | Device took over 5 hours to charge. Indicates bad charge source or board level issue | 10 green blinks and shutoff |
| Charge Fault 1 | Bad charge source, bad internal connection to battery, or issue with charging circuit | 10 white blinks and shutoff |
| Charge Fault 2 | Bad connection between charge controller and microcontroller | 10 sky blue blinks and shutoff |

FIG. 11C

VAPORIZATION DEVICE HAVING INTEGRATED GAMES

CROSS REFERENCE TO RELATED APPLICATIONS

This patent application claims priority to U.S. Provisional Patent Application No. 62/306,551, titled "VAPORIZATION DEVICE HAVING INTEGRATED GAMES," filed on Mar. 10, 2016.

This application may be related to one or more of the following applications (or continuations thereof) including: U.S. patent application Ser. No. 14/581,666, titled "VAPORIZATION DEVICE SYSTEMS AND METHODS," filed on Dec. 23, 2014, Publication No. US-2015-0208729-A1; and U.S. patent application Ser. No. 15/368,539, titled "LOW TEMPERATURE ELECTRONIC VAPORIZATION DEVICE AND METHODS," filed on Dec. 2, 2016, which is a continuation of U.S. patent application Ser. No. 13/587,416, titled "LOW TEMPERATURE ELECTRONIC VAPORIZATION DEVICE AND METHODS," filed Aug. 16, 2012, now U.S. Pat. No. 9,408,416. Each of these patent applications and patents is herein incorporated by reference in its entirety.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

Described herein are inhalable aerosol producing devices (which may include and/or be alternatively referred to as electronic vaping devices, vaporization devices, vaporizers, and/or e-cigarettes), and particularly electronic aerosol devices which include one or more user-interactive games. The games may modify the function and behavior of the vaporizer.

BACKGROUND

Vaporization devices are a popular alternative to the traditional act of burning tobacco and inhaling the resulting smoke. Inhaling vapors from such devices may be safer than directly inhaling smoke from burning tobacco or products containing byproducts from combustion. Vaporizers also produce less second-hand exposure compared to traditional smoking.

Vaporization devices may also be used in social settings. Unlike smoke from traditional smoking that pervades the surrounding environment and may aggravate those not accustomed to or interested in inhaling smoke byproducts, vaporizers may be safely used for the enjoyment of those wishing to partake and leaving others free from harmful fumes.

It would therefore be useful to provide apparatuses (devices and systems) that may further increase the enjoyment and social interactions for those using vaporization devices, including providing users of vaporization devices with further avenues of enjoyment as well as additional socializing opportunities. In particular, it would be useful to provide such entertainment in a manner that is integrated with the functioning of the device, so that it does not disrupt the operation of the device, but may instead enhance it.

SUMMARY OF THE DISCLOSURE

The present invention relates to vaporization apparatuses (devices and systems) this include an entertainment mode that includes one or more games and/or an output/display for entertaining the user. The apparatus may be manipulated by the user, applying a predetermined input or pattern of inputs (such as rolling the device along an axis, entering a series of button pushes, taps, or lip contacts, etc.) to enter from a normal operational mode into the entertainment mode. In the entertainment mode, the apparatus may operate as normal, allowing vaporization of a vaporizable material by a heater, but may modify the control of the heater. For example, in the entertainment mode, the controller may be configured to delay or prevent entry into a standby state in which the heater is cooled below a predetermined operational temperature. The entertainment mode may include features such as games and/or entertainment outputs (e.g., tones or music, light displays, vibrations, etc.).

For example, described herein are vaporizers devices that form part of a system including a user interface adapted to control a remote device, such as a hand-held communications device (e.g., smartphone, smartwatch, wearable electronics, etc.), wherein the user interface includes a controlling the entertainment mode. The user interface ("application software") may control the vaporizer, including selecting the entertainment mode and/or selecting one or more games and/or beginning or stopping the game, selecting a number of players, and controlling the operation of the vaporizer, including oven temperature, on/off, standby mode, illumination intensity, etc. Thus, any of the methods and apparatuses (systems, devices, vaporizers, etc.) described herein may optionally be used with a remote, hand-held communications device for selecting and/or controlling the vaporizer including entering and operating the entertainment mode.

In general, described herein are vaporization devices comprising: a heater configured to vaporize a vaporizable material; an output on the device; an input on the device configured to be manipulated by a user; and a controller adapted to regulate the temperature of the heater, wherein the controller comprises a normal mode and an entertainment mode comprising one or more games configured to be played using the input and output.

The heater may comprise or be connected to an oven, heating coil(s), resistive heater, or the like. The heater may be connected to the controller by wires, conductive traces, or the like. The controller may be one or more microcontrollers, and my include circuitry (e.g., control circuitry) for executing control logic, including proportional integral derivative (PID) logic, for regulating the heater (e.g., oven) temperature.

Any of the vaporization devices (vaporizers) described herein may also include an outer case, a mouthpiece, and a charging connector(s). The device may also be wired or wirelessly connected or connectable (e.g., via WiFi, Bluetooth, etc.). In some variations the games may be interactive with one or more other device or gaming consoles through this wireless connection (e.g., the device may transmit motion data for use in a game running on a separate processor such as a gaming console, smartphone, computer, etc.). Any of these vaporizers may also include a mouthpiece from which vapor may be drawn, e.g., by inhaling, by a user.

In general, these vaporization devices may include an output. The output may be a visual output such as one or more preferably a plurality of LEDs. The LEDs may be of one or more (e.g., RGB) colors. The LEDs may be arranged in a pattern, such as a line, circle, etc. Other output may additionally or alternatively include a mechanical or vibrational output such as a piezo-driven element. The output may include a speaker or the like.

Any of these vaporization devices may include one or more inputs for detecting user control or input. For example, the input may be an accelerometer for detecting motion (acceleration) and/or position of the apparatus. In some variation the accelerometer may be single-axis, dual-axis or tri-axial. Other inputs may include buttons, switches, sliders, or the like. Any of these inputs may be capacitive inputs to detect contact with a user's skin (e.g., lips, fingers, etc.).

For example, a vaporization device may include a heater configured to vaporize a vaporizable material; an output on the device; an input on the device configured to be manipulated by a user; and a controller adapted to regulate the temperature of the heater, wherein the device comprises a normal mode and an entertainment mode comprising one or more games configured to be played using the input and output.

A vaporization device may include a heater configured to vaporize a vaporizable material; an output on the device; an input on the device configured to be manipulated by a user; and a controller adapted to regulate the temperature of the heater, wherein the device comprises a normal mode and an entertainment mode comprising one or more games configured to be played using the input and output, further wherein the controller is configured to maintain the temperature of the heater at a vaporization temperature for a longer time when the device is in the entertainment mode compared to the normal mode.

A vaporization device may include: a heater configured to vaporize a vaporizable material; an output comprising a plurality of LEDs on the device; an input comprising a motion detector configured to detect movement of the device; and a controller adapted to regulate the temperature of the heater, wherein the device comprises a normal mode and an entertainment mode comprising one or more games configured to be played using the input and output, further wherein the controller is configured to maintain the temperature of the heater at a vaporization temperature for a longer time when the device is in the entertainment mode compared to the normal mode.

In general, the controller may be configured to maintain the temperature of the heater at a vaporization temperature for a longer time when the device is in the entertainment mode compared to the normal mode. The operation of the device in the entertainment mode may be modified in other ways as well. For example, the heater may be heated to different temperature (or cooled) while the apparatus is in the entertainment mode.

In general, these apparatuses may include a standby state (also referred to herein a standby mode). The controller may be configured to enter the standby mode after a predetermined time period during which the device is not operated (e.g., no input is entered/activated. For example, if a skin (e.g., lip) contact with the mouthpiece is not detected, and/or if the device is not moved, the controller may enter the standby mode after a predetermined period of time. While in the standby mode, the device may control the heater to step or ramp-down the heater temperature from an operational temperature. The duration between steps (or the steepness of the ramping) may depend on the operational mode. For example, in the normal operational mode, the device may enter a standby state after a first predetermined time period of inactivity (no contact and/or movement), such as 1 min, 2 min, 3 min, 4 min, 5 min, 6 min, 7 min, 8 min, 9 min, 10 min, etc., which may preserve battery power. When the device is in the entertainment mode (also sometimes referred to herein as "party mode"), the device may enter a standby state after a second predetermined time period of inactivity (no contact and/or no movement), such as 2 min, 3 min, 4 min, 5 min, 6 min, 7 min, 8 min, 9 min, 10 min, etc. Once in a standby state, the device may eventually power down, following one or more periods of decreasing the temperature, unless activity (e.g., movement of the device and/or lip contact) resumes. For example, in the normal operational mode, the PID control may hold the heater to a set temperature by controlling the heater at a particular duty cycle (e.g., the percent of "on" time during which power is applied to the heater over time), to maintain a target heater temperature or temperature range. When the device enters a standby state in the normal mode, the controller may step the down the target temp for the heater, e.g., by 5 degrees C. for a first period of, e.g., 20 seconds, and if still inactive, may step down two more times by the step-down amount (e.g., 5 degrees C.) following consecutive periods of inactivity (e.g., 20 seconds each). In the entertainment mode, the standby state may be modified or suspended. For example, as mentioned the standby state in the entertainment mode may be entered after a longer period of inactivity (e.g., 2× the normal mode period), which may include increasing the periods of inactivity (e.g., from 20 seconds to 40 seconds, etc.).

In any of these variations, the operational temperature of the heater may be selected (e.g., in a temperature setting/selecting mode) from a predetermined set of operational temperatures for the heater.

As mentioned, in general, the entertainment mode may include one or more presentations (e.g., LED light displays, tones/music, patterns of vibrations, or combinations of these) and/or games. The device may be configured to allow selection of the presentation states or game states (games) to be played, or it may randomly select one. In general the games may be interactive, allowing the user to provide input, e.g., via the one or more inputs, such as movement of the device, via motions sensing, touching the device, via a button and/or capacitive sensor (e.g., lip sensing, etc.).

For example, the entertainment mode may include a game such as a pattern-following game, wherein the device presents an output (e.g., one or more LEDS illuminated in a pattern and/or color), and the device (e.g. controller) may determine if a response entered by the user on the input correlates with a predetermined response. In general, the same controller used to control the heater may be used to control the entertainment mode including the games. Alternatively a separate controller may be used, and may communicate with the controller controlling the heater.

The one or more games may include a memory game. For example, in a memory game the device may presents an output sequence and determines if a sequence of responses entered by the user on the input correlates with a predetermined sequence of responses. The one or more games may include a triggered output game wherein the device presents an output in response to a predetermined user input. For example, the device may illuminate a series differently positioned and/or colored LEDs based on the angle or movement that the user holds the device.

The one or more games may include a chance type game, wherein the device is configured to display a random pattern of one or more of colors, tones or vibrations, in response to a predetermined user input. The entertainment mode may include a display game wherein the output comprises a plurality of LEDs and wherein the device is configured to cycle the LEDs through a predetermined sequence of colors in response to a predetermined user input. The entertainment mode may include a tone game wherein the output comprises a plurality of tones and wherein the device is configured to play a predetermined sequence of tones in response to a predetermined user input.

As mentioned, the device may be configured to be toggled between the normal mode and the entertainment mode by applying one or more predetermined user manipulations to the input. For example, the device may be rotated. In some variations, the device input comprises an accelerometer, and the device may be configured to be toggled between the normal mode and the entertainment mode by rolling or rotating the device (e.g., three or more times) in one or more directions.

In addition to or alternative to the games, the entertainment mode may include an entertainment output (display) that is triggered upon entering into the entertainment mode. For example, as mentioned, the entertainment output may include one or more of: a display of a plurality of colors and/or patterns on the output, a tone or series of tones, a vibration or series of vibrations.

In general, also described herein are methods of playing games on a vaporization device having an output, an input, a heater to vaporize a vaporizable material and a controller configured to regulate the heater, the method comprising: operating the vaporization device in a normal mode wherein the controller regulates the temperature of the heater to vaporize a vaporizable material; activating an entertainment mode on the vaporization device by applying a predetermined user manipulation to the input; and playing a game with the device using the output while the device is in the entertainment mode, wherein the controller is configured to operate the heater to allow vaporization of vaporizable material when in the entertainment mode.

A method of playing games on a vaporization device having an output, an input, a heater to vaporize a vaporizable material and a controller configured to regulate the heater, the method may include: operating the vaporization device in a normal mode wherein the controller regulates the temperature of the heater to vaporize a vaporizable material; activating an entertainment mode (e.g., by selecting entertainment mode in a user interface of a remote hand-held communications device such as a smartphone and/or directly on the vaporization device by applying a predetermined user manipulation to the input); and playing an interactive game with the device using the input and output while the device is in the entertainment mode, wherein the controller is configured to operate the heater to allow vaporization of vaporizable material when in the entertainment mode.

A method of playing games on a vaporization device having an output, an input, a heater to vaporize a vaporizable material and a controller configured to regulate the heater, may include: operating the vaporization device in a normal mode wherein the controller regulates the temperature of the heater to vaporize a vaporizable material; entering a standby mode after a period of inactivity having a first duration, wherein the controller reduces the temperature of the heater by a first predetermined amount; activating an entertainment mode on the vaporization device by applying a predetermined user manipulation to the input (including via a user interface on a hand-held communications device); playing an interactive game with the device using the input and output while the device is in the entertainment mode, entering a standby mode after a period of inactivity having a second duration that is longer than the first duration when the device is in entertainment mode, wherein the controller reduces the temperature of the heater by a first predetermined amount.

Any of these methods may include selecting a game using a second predetermined user manipulation to the input when the device is in the entertainment mode. As mentioned, the predetermined user manipulation may include rolling or rotating the device along its long or short axis.

Any of these methods may include playing a game with the device comprising playing an interactive game using the input and output. For example, any of these methods may include playing one or more of: a display of a plurality of colors and/or patterns on the output, a tone or series of tones, a vibration or series of vibrations. Playing an interactive game may include playing a pattern-following game wherein the device presents an output and determines if a response entered by a user on the input correlates with a predetermined response.

Playing the interactive game may include playing a memory game wherein the device presents an output sequence and determines if a sequence of responses entered by a user on the input correlates with a predetermined sequence of responses. Playing the interactive game may include playing a triggered output game wherein the device presents an output in response to a predetermined user input. Playing the interactive game may include playing a chance type game, wherein the device is configured to display a random pattern of one or more of colors, tones or vibrations, in response to a predetermined user input.

The vaporization apparatuses (e.g., vaporization devices) described herein may include an outer surface that includes one or a series of LED lights disposed there upon (output(s)). The vaporization devices described here may also include various inputs comprising one or more sensors, such as a motion sensor or accelerometer, to detect various orientations and/or movements that a user may impart on the device. The vaporization devices may also include a controller that is able to correlate the readings from the sensors to a displayed light pattern on an LED light display window on the device. As will be described below, the vaporization device may include various entertainment and game modes that enhance the user's experience while using the vaporization device.

The LED light display window may include four segments formed in a pattern such as an "X". There may be more than one LED light display windows disposed on the outer surface of the vaporization device, where the sets of LED light display windows may for a pattern on the vaporization device. In other examples, the LED light display window may be in a different pattern and/or may include additional LEDs.

There are a variety of ways that the lights may be displayed on the LED light display window. The collection of LED lights may display one color light on one of the segments, where the one color light may travel onto the other LED display segments in either a random or sequential pattern. The same light may be displayed on some or all of the LED segments. Different combinations of colors may be displayed on the LED light display segments. The LED lights may be continuously shown or may blink at a fast or slow rate. The LED lights shown may cycle through the different LED light display segments.

In some aspects, the user may gain access to the entertainment or game modes on the vaporization device through a specific sequence of orientational manipulations to the device. This may include rotating the device either on its long or short axis a set number of times in one or more directions such as clockwise or counterclockwise. The device may also be placed in the entertainment or game modes but a certain type of motion that the user may impart on the device (e.g. flicking the mouth end of the device three times).

Once the device is placed in an entertainment mode such as a party mode, the collection of LED lights may cycle through the different LED light display window segments in a particular pattern of light colors, and in a predetermined rate. In some entertainment mode, the device may play a clip of a song, where the song clip may be coordinated with the LED lights displayed.

The user may unlock the games ("game modes") of the vaporization device in a similar manner as when engaging the entertainment mode. The user may manipulate the orientation of the device in a particular sequence or use a sequence of predetermined motions to gain access to the game modes.

Game modes may include games that test the user's ability to follow and remember patterns of LED lights shown in the LED lights display window segments. As the user succeeds in following such patterns the sequence displayed may be longer or may come at a faster rate. In some other variations, the user must follow the sequence of light patterns only when there is a particular tone associated with the sequence, and must refrain from following the sequence if no tone or a different tone is played along with a sequence.

In other game modes, the user is designated by a particular LED first color. The LED first color must avoid a particular LED second color. When possible the user must manipulate the device such that the LED first color captures a LED third color when it is shown. The LED third color gives the LED first color energy after a certain number of LED third colors have been captured, such that the LED first color may not pursue the LED second color until the LED first color runs out of time, in which case, the pursuer and pursued roles revert back to what they were originally.

Some aspect of the device includes an outer surface, a series of LED lights disposed on the outer surface of the vaporization device, a motion detector that is able to detect movement of the vaporization device, and a controller that is able to sense and correlate the motions sensed and the LED lights displayed through the LED light display window segments. The device may include entertainment and game modes that may be accessed through a series of user manipulations to the vaporization device. Manipulations to the device may include a series of tilts, clockwise rotations or counterclockwise rotations about the device's long or short axis, one or more flicks, or a combination of any of these other movements to the device. Once the user has successfully entered a party mode, special sequences of LED lights may be displayed on the LED light display window segments. Once the user has succeeded in entering a game mode through orientational manipulation of the device, then they may be able to play a number of games on the device while using the device.

In some instances, the series of LED lights may show different colors or the same colors. The colors may be shown blink at a fast or slow rate or may stay one. In some instances, the colors may cycle through various patterns as the LED light travels through the LED light display window segments. For example, a carousel of rainbow colors may be seen as the lights repeated cycle through the LED light display window segments and change colors in an order of red-orange-yellow-green-blue-violate.

In some instances, a musical clip may be coupled to a LED light sequence and both displayed simultaneously. The combination of audio and visual output may be at the end of a successful series of manipulations to on the device by the user.

In some instances, the game played may be a memory type game. In this game, the user following a pattern of LED light sequences displayed by moving the device in a corresponding direction, where the motion detector within the device is able to sense the device motion and the controller is able to determine if the user has correctly implemented the pattern of LED light sequence displayed. Game play continues until the user fails to properly follow the sequence that the device outputs.

In some instances, the game played may be a Simon says type game. Here, the user follows a pattern of LED lights only if the patterns of LED lights are associated with a certain audio tone. If LED lights are displayed with either no tone or a different tone, then the user must refrain from following the LED lights. Added difficulty may include displaying the sequence at a faster rate.

In some instances, a pursuit game may be implemented. The user is designed with a first LED color and must avoid being caught by a second LED light color. As the user/first color LED light moves about LED light display window segments, it must attempt to capture a third color LED light that may occasionally display to gain energy. Once sufficient energy is obtained, the user/first color LED may now chase and attempt to capture the second color/LED light until its energy runs out, in which case, the first and the second LED lights revert back to their original roles.

In some instances, a game of change may also be played on the device. Here the user may direct the device to display colors on the LED lights window segment through a manipulation of the device (e.g. two flicks). Prior to initiating a color display, the user and others may guess what the pattern that will be displayed may be. The person coming closest to the actual pattern wins.

Also disclosed are associated methods of playing games and using the entertainment features of the vaporization device that includes LED light display disposed on the outer surface of the device. In general, the method includes activating a game or entertainment mode on the vaporization device by using a first series of predetermined manipulations of the vaporization device and then selecting a game using a second series of predetermined manipulations of the vaporization device. The LED light display is able to display a multitude of colors either, singly, in combination with other colors, sequentially, periodically, or continuously. The first or the second series of predetermined manipulations to the vaporization device includes a preset number of specific motions (e.g. flicks, swirls, circles), or clockwise or counterclockwise rotations to the vaporization device along its long or short axis. In most instances, the first set of predetermined manipulations is different from the second set of predetermined manipulations of the vaporization device.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

In FIG. 1B the device of FIG. 1A is rotated or rolled along its long axis to enter the entertainment mode (e.g., rotating three times).

FIG. 10 is a table (table 1) listing games and/or displays that may be available in an entertainment mode of an apparatus as described herein.

FIGS. 11A (table 2), 11B (table 3), and 11C (table 4) provide examples of other user interface states and interactions that may be available in the normal and/or entertainment modes. FIG. 11A shows exemplary device state indicators. FIG. 11B illustrates exemplary user interactions. FIG. 11C illustrates exemplary error indicators.

FIGS. 12A and 12B show a cartridge placed within the reusable component of the device.

In FIG. 13B, a remote user interface 1309 is shown communicating with the apparatus (e.g., to select entertainment mode, game, number of players, etc.) wirelessly 1311. The user interface may be part of an application software ("app") running on, e.g., a smartphone or the like.

DETAILED DESCRIPTION

Described herein are activities (e.g. games) that can be played on a vaporization device during use of the device. The activities described herein are often hidden features of the vaporization device that have to be unlocked through some predetermined pattern of manipulating the vaporization device.

Vaporization Device

In general, the vaporization devices described herein includes a mouthpiece, a body; an electronic heater within said body comprising a printed circuit board to heat a vaporizable material to a generate an inhalable aerosol; and a temperature regulator.

Figure 1A:
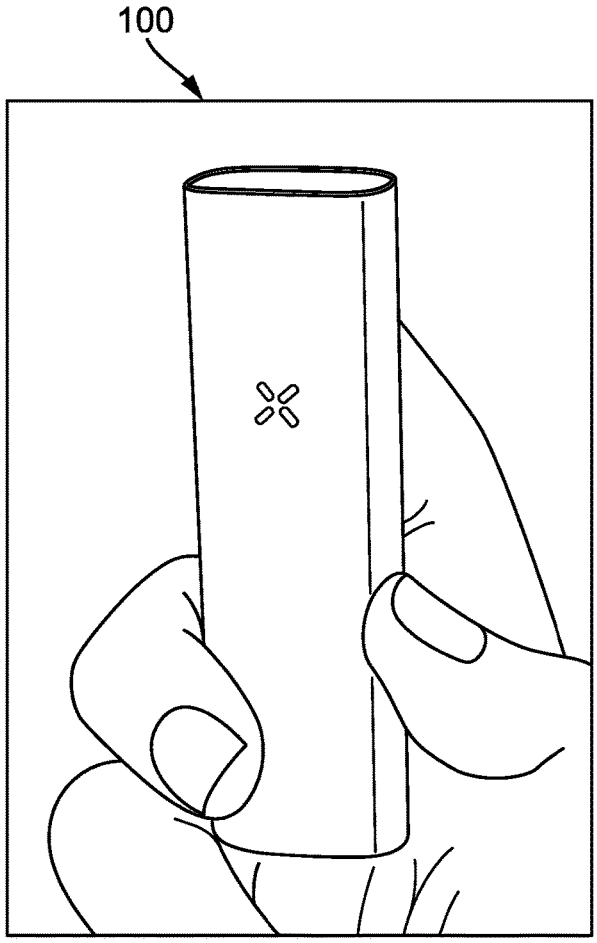
FIG. 1A is a perspective of a vaporization device as described herein.

FIGS. 1A-1D illustrate one variation of a vaporizer (vaporization device) as described herein. For example, in FIG. 1A, a vaporization device 100 is shown held in a user hand, showing the front of the device with an exemplary output (four LEDs arranged in an "X" shape). In any of the apparatuses (e.g., vaporization devices) described herein, the apparatus may include a "normal" operational mode within which a vaporizable material may be vaporized by the heater, and an "entertainment mode" which still permits vaporization of vaporizable material, but also provides the user with an entertaining presentation or interaction. The user may selectively toggle between the normal mode and the entertainment mode by, for example, providing a predetermined sequence of input(s) to the device. In some variations the device may be switched from normal mode to entertainment mode (and/or in some variations back to normal mode from entertainment mode) by pressing a button, by sliding a slider, by tapping or contacting on the device in a predetermined location (e.g., side, bottom, mouthpiece, etc.), by tapping a specific pattern, by drawing on the device in a particular pattern, duration or frequency, and/or by moving the device in a predetermined manner. For example, FIG. 1A illustrates one example of a method of toggling between normal and entertainment mode, by rotating or rolling the device 100 in a horizontal position, where the long axis of the device is parallel to the floor, about the long axis of the device. Alternatively or additionally a user may select entertainment mode (e.g., games) via a user interface of an app running on a smartphone or other hand-held/worn communications device with a processor. FIG. 1A shows it starting from the front 111, rotating on the side 112, and around to the back 113. This rotation may be continued until it has gone through one or more (e.g., 2, 3, 4, 5, 6, etc.) rotations, at which point it may enter the entertainment ("party") mode. Alternatively other movement (rolling, rotating, etc.) patterns may be used.

Figure 1B:
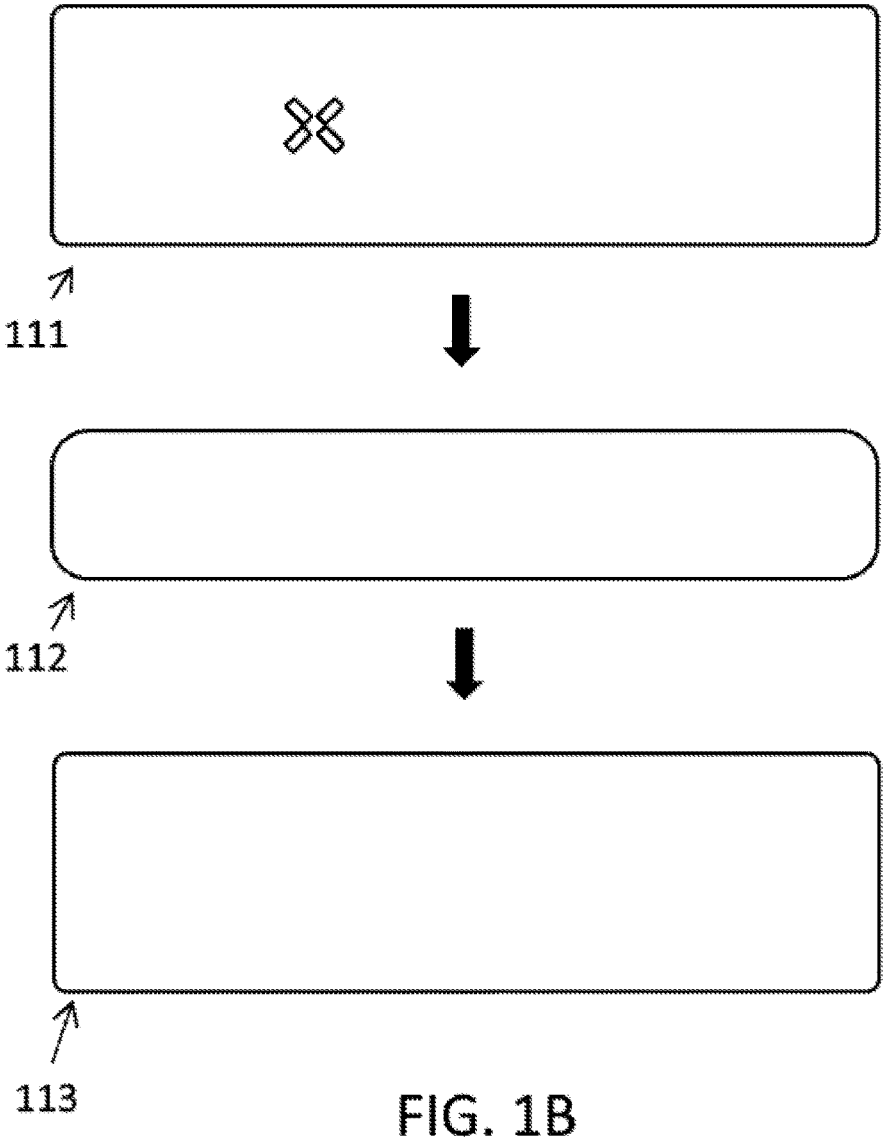
FIG. 1B is illustrates a predetermined pattern of input for a device including a motion sensor in order to toggle between a normal mode and an entertainment mode.
Figure 1C:
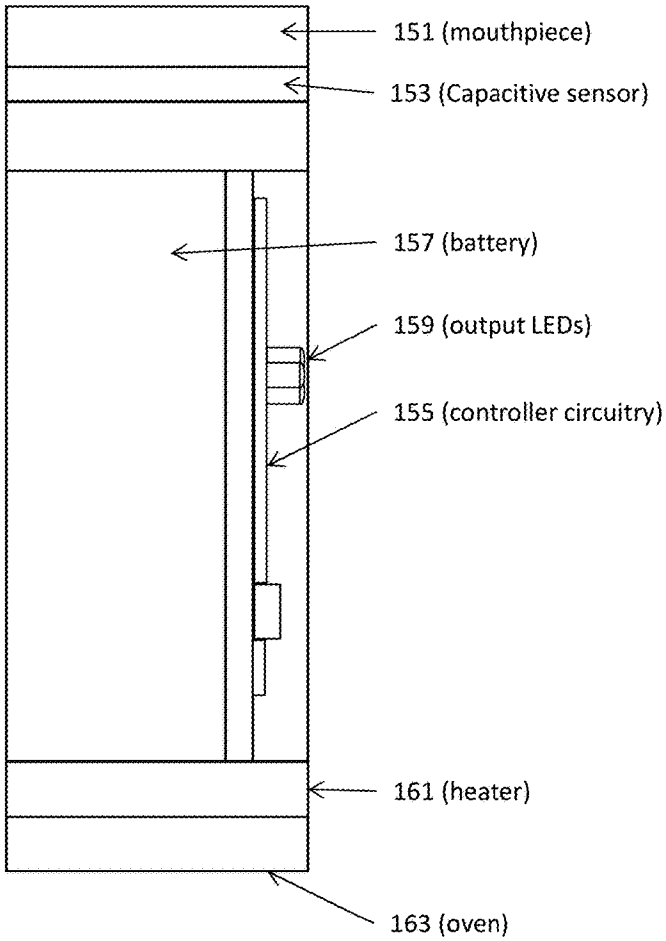
FIG. 1C is a schematic view of a vaporization device.

FIG. 1C illustrates a schematic of a generic vaporization device having a mouthpiece 151 adjacent to which a capacitive sensor 153 is attached, which may be used to sense contact with the user (e.g. the users lip or mouth) in contact with the mouthpiece. This input (sensor or capacitive sensor) may be connected to the controller (control circuitry 155). A battery 157 may provide power to the device and may be rechargeable or disposable. The heater 161 may be controlled by the controller 155. In some variations an oven 163 is coupled to the heater for vaporizing a material (e.g., loose-leaf vaporization materials such as tobacco or cannabis).

In some variations the vaporizer may be configured to accommodate a pod comprising vaporizable material (e.g., particles) that are less than about 2 microns (in their longest dimension—whether length or width or depth). In some variations the apparatus may be configured to operate on a solution (e.g., nicotine solution or other vaporizable material). The heater may be part of a cartridge or pod, or it may be integrated into the body of the apparatus. In some variations the apparatus is configured to vaporize a loose leaf tobacco and other botanical material. The heater may include an oven or other chamber into which the vaporizable material may be placed.

The vaporization device generates an inhalable aerosol and may include a mouthpiece; a body; an electronic heater comprising a heater circuit and a printed circuit board (controller) within the body. The electronic heater may be configured to heat a vaporizable material and generate an inhalable aerosol. The controller may be configured as a temperature regulator.

In some embodiments, the mouthpiece is split or integrated into the device. In some embodiments, the mouthpiece retracts from the device with a push-push mechanism. In some variations the mouthpiece is removable from the device (e.g., part of a cartridge or pod).

In some embodiments, the heater circuit may be soldered to a heater circuit board (controller). In some embodiments, the electronic heater comprises a resistive heating element. The heating circuit may include a thermistor configured monitor and precisely control vaporization temperature of the viscous vaporizable material. In some embodiments, the heater circuit is a thin film polyimide heater. In some embodiments, the electronic heater is sealed by a hermetic or dust seal.

In some embodiments, the device may include a magnetic control using reed or Hall Effect switch. In some embodiments, the magnetic control using reed or Hall Effect switch is integrated into the mouthpiece.

In some embodiments, the device comprises a magnetic lid that covers the heater/oven.

In some embodiments, the device comprises a thermally conductive shell configured to distribute excess heat and configured maintain a low exposed surface temperature.

In some embodiments, the device (e.g., the device controller) comprises a timer. The devices may also include one or more sensors, e.g., an accelerometer or other tactile/vibration sensor, capacitive (touch) sensor, or a sensor for monitoring the thermistor configured to detect if the heater is being loaded by the user puffing on the device, etc.

In some embodiments, the device comprises a proportional integral derivative (PID) control loop configured to control operating temperature. The PID control may be part of the hardware, software, firmware or some combination thereof on or part of the controller.

In some embodiments, the device comprises a thin wall metal heating chamber (e.g., heater or oven).

In some embodiments, the device comprises aerogel insulation. In some embodiments, the aerogel insulation comprises a silica aerogel with reinforcing fibers.

In some embodiments, the heater is thermal pressed, ultrasonic bonded or over-molded into a high temperature capable plastic component. In some embodiments, the heater is heat stated or heat swaged into a high temperature capable plastic component. In some embodiments, the heater is heat swaged into a high temperature capable plastic component.

In some embodiments, the device further comprises a magnetic charge connector configured to connect the device to a charger.

In some embodiments, the device comprises a single button interface. The button may be on or behind the mouthpiece. The button may be on the side of the device.

The vaporization device in some variations includes a single button interface for on, off, wake from sleep mechanism, and a heater circuit soldered to a PCB and a battery (e.g., a LiPo battery). In some variations the device includes a body having outer halves that snap together to hold and protect the device. In some instances, the outer body is molded as one part. In some embodiments, the single button interface that provides mechanism for on, off and wake from sleep. In other embodiments, additional buttons are included for any of these functions. For example, pressing the single button for 1 second turns the device on. Continuing to hold the button for 5 seconds disables the motion-based low power standby and automatic shut-down. Alternatively, a second button may be used to disable the motion-based low power standby and and/or shut-down. If a user does not want the device to cool down while resting on a table, e.g., they can use this override. In some embodiments, upon power-up, if the single button is depressed for a very long period (>10 seconds), the device turns off again. This may prevent inadvertent activation while in a purse, etc. While on, pressing the button momentarily turns it off. In some embodiments, a single or more than one button could report battery level (via LED blinks, for instance), change operating temperature of the device, or change the nominal intensity of the LED(s)—if the user is in a dark environment and does not want the light to be distracting. These various features could be triggered with one or more buttons or with the same button by pressing it for a prescribed duration or number of presses.

As described herein, an electronic heater may include or be part of a heater circuit, an oven and a printed circuit board to generate an inhalable aerosol. The heater circuit may be flexible. In some embodiments, flexible heater circuits are typically etched from a copper- or constantan-clad polyimide film. In some embodiments, a flexible heater is constructed by stamping (e.g., die-cutting) a thin sheet of constantan or copper. In this case, the heater circuit would have to be electrically insulated from adjacent conductive elements in the assembly, using polyimide or other suitable insulation that is stable at elevated temperatures. The heater circuit heats the attached oven which then heats the cartridge or active substance by thermal conduction. The resistive heater circuit heats up as current passes through it. Heat is then conducted from the circuit to the oven walls. Thermal conduction continues from the oven walls into the cartridge or active substance. Note that heat also transfers from the oven walls into the active substance or cartridge via convection and radiation, but most transfer occurs via conduction.

In some embodiments, the device comprises more than one button interface for on, off, wake from sleep mechanism and a heater circuit soldered to a PCB.

As descried, in any of these variations, the device may include a time or sensor based standby state to conserve battery power. This may also or alternatively be called a standby mode. The standby state may also or alternatively be called sleep, or sleep mode. After non-use based on inactivity (lack of movement or lip contact), position (e.g. vertical), or placement in a charging cradle, or after any combination of any of these, the device controller may convert to sleep mode (standby mode), in order to conserve battery power. The device may be awoken from this standby or sleep mode by a change in any of: movement (e.g. horizontal from vertical, vertical from horizontal, or movement indicating the user has picked up the device), removal from the charging cradle, user touch, the user puffing on the device, or activation by pressing any button on the device (or any combinations thereof). After an extended period in standby mode, the device will turn off, to be awoken and/or turned on, e.g., by the user pressing the button on the device, in some embodiments, or by the user puffing on the device. In some examples, simply moving the device or removing it from its charging cradle will not activate the device once turned off. In other embodiments, moving the device or removing it from its charging cradle does turn on the device from off or standby mode.

In some embodiments, standby mode conserves battery power by lowering the regulation temperature of the device. For example, a large portion of the heat generated by the device may be lost to the environment, whether or not the user is puffing on it. So maximizing the time the device spends in standby, and minimizing the internal temperature while it's in standby conserve power. However, when the device awakes from standby, it is desirable for it to return to the main operating temperature as quickly as possible, so as to give the impression of an uninterrupted puffing experience to the user. So a balance must be established. For example, on the current electronic cartridge-based device, the main operating temperature is 165° C., and standby temperature is 150° C. This temperature difference is slight enough that if the user wakes the device from standby, by the time the user starts puffing, the heater has had enough time to raise the temperature and the user perceives little or no interruption in production of vapor. In some embodiments, the temperature difference is set to be 30° C., 25° C., 20° C., 15° C., 10° C., or 5° C. between the main operating temperature and standby temperature. In some embodiments, the temperature difference is set to be any temperature from 30° C. to 5° C. between the main operating temperature and standby temperature.

In some embodiments, the battery is a disposable battery. In other embodiments, the battery is a rechargeable battery. In certain embodiments, the rechargeable battery is a lead-acid, nickel cadmium (NiCd), nickel metal hydride (NiMH), lithium ion (Li-ion), lithium ion polymer (Li-ion polymer or LiPo), or the like.

A rechargeable battery, storage battery, or accumulator is a type of electrical battery. It comprises one or more electrochemical cells, and is a type of energy accumulator. It is known as a secondary cell because its electrochemical reactions are electrically reversible. Rechargeable batteries come in many different shapes and sizes, ranging from button cells to megawatt systems connected to stabilize an electrical distribution network. Several different combinations of chemicals are commonly used, including: lead—acid, nickel cadmium (NiCd), nickel metal hydride (NiMH), lithium ion (Li-ion), and lithium ion polymer (Li-ion polymer, Li-poly, Li-Pol, LiPo, LIP, PLI or LiP).

The device is capable of creating temperatures high enough to aerosolize a product contained within the device. A user-selected temperature, as described above, could be used as an input to this system. In some embodiments, the temperature could be pre-set. Examples of operating temperature regulators of a device include a bimetallic actuator. Alternatively, a system could be employed to measure the current temperature, for example, with a thermocouple sensor and compare it to a prescribed temperature, for example, with a micro-controller, and by controlling an electromechanical valve, for example, servo or solenoid valve. A user-selected temperature, as described above, the selected temperature could be used as an input to this system. Typically, the operating temperatures of the device are no more than 300° C. (e.g., no more than 240° C., no more than 220° C., no more than 200° C., etc.).

In certain embodiments the heater includes a soldered thermistor element for control loop (PID) control. In certain embodiments, the device comprises a PID (proportional integral derivative) control loop to control operating temperature. The control loop may serve to precisely regulate the desired set point temperature for the device. Depending on the design and intended use of the device, the set point temperature, in some embodiments, is fixed; in other embodiments, the set point temperature is user-selectable. The set point can also change dynamically during device operation. For example, in standby mode the set point is lowered a certain amount. In some embodiments, the input for the control loop is typically a thermistor, located on or adjacent to the heater circuit. This thermistor leads to a microcontroller which makes A/D measurements and the resulting value is used in calculating the PID control variable. The control variable then sets the duty cycle (and resulting power output) of the heater circuit.

An exemplary device may include a thin-walled stainless steel tube (e.g. a metallic "oven") that is thermal pressed (e.g., heat staked or swaged), ultrasonic bonded or overmolded into a high temperature capable plastic component. The processes create a hermetic or dust seal (air-tight seal), which prevents environmental dust from entering the internal chambers of the device, as well as any dust from the internal insulation materials from escaping the device and entering the heating chamber. The plastic component may comprise any thermoplastic materials that provide high temperature stability. In some embodiments, the plastic component comprises polyphenylene sulfide (PPS, trade name Ryton), polyetherimide (PEI, trade name Ultem), liquid crystal polymer (LCP), or the like. In certain embodiments, the plastic component comprises PPS. PPS is used also for its general good moldability.

U.S. Patent Application Publication Nos. 2013/0042865, 2013/0312742, and 2015/0208729, herein incorporated by reference in their entirety, describe vaporization devices that may be adapted as described herein to include and operate an entertainment mode, and provide examples of heaters, outputs, inputs, etc.

In some embodiments, the device also includes a tactile button with LED-illuminated "halo" indicator. The indicator reports information about the state of the device. In some embodiments, a saw-tooth pattern indicates that it is heating up. In some embodiments, solid pattern indicates that the set point temperature has been reached and the user can start puffing on the device. If the battery is critically low, in some embodiments, the LED indicator flashes several times (e.g., 5 times) and then the devices turn off. In some embodiments, while shaking the device, the motion sensor detects this and the LED indicates current battery level: for example, 3 flashes for full charge, 2 flashes for partial charge, and 1 flash for low charge. The device then resumes normal operation. When the device is placed in a charge cradle, in some embodiments, a saw-tooth pattern indicates that it is charging. In certain embodiments, when charging is complete, the LED turns solid. In some embodiments, error states can also be reported: if an internal failure is determined, the indicator flashes 10 times and the device turns itself off.

Many devices use a temperature regulation scheme in that the temperature regulator (bimetallic discs or other regulator) are located in close proximity to the area where temperature is most critical (at the oven). Related art has typically located the temperature-sensitive component at the flow valve, which can be easily influenced by the cool temperature of expanding fuel gas and has minimally intimate contact with the vaporizing chamber. Examples of related devices and methods are described in U.S. patent application Ser. No. 11/485,168, U.S. Pat. No. 4,819,665, U.S. Pat. No. 4,793,365, U.S. Pat. No. 5,027,836 and PCT Application Publication No. WO2006/082571. The regulation scheme of an exemplary device may be tuned to a specific temperature by a simple twist of the oven.

In some embodiments, the devices described herein may include a button-operated temperature selection with visual, audible indicator, and/or other sensory output (e.g. vibration). In some embodiments, a tactile (mechanical) switch is used as input to a microcontroller, which, via its software, indicates the change to the user (e.g., by visual LED, audible, vibration, or the like), and changes the set point temperature of the device. The switch can also be capacitive, resistive, or the like.

Any of the devices described herein may include a charger base (an exemplary USB charger) comprising a rare earth magnet charge base interface. The battery (e.g., a Li-ion battery) is charged with the help of a flex PCB continues down to make contact with battery terminal Also shown for the device are button, accelerometer, aerogel and thermistor to monitor and precisely control vaporization temperature. Various embodiments of mouthpiece as described herein or known to one of ordinary skilled in the art may be used.

Any material that is capable of being aerosolized and inhaled by a user may be incorporated into a device or Cartridges described herein, as would be obvious to one skilled in the art. It is of particular interest that the material provides an experience to the user either in terms of tactile response in the respiratory tract, or in terms of visual feedback regarding the exhalation of the inhaled material. For example, many materials have be contemplated for use with the present invention including, but not limited to, those containing tobacco, natural or artificial flavorants, coffee grounds or coffee beans, mint, chamomile, lemon, honey, tea leaves, cocoa, and other non-tobacco alternatives based on other botanicals. A device or cartridge of the invention can also be compatible for use with pharmaceutical compounds or synthetic compounds, either for pharmaceutical or pleasurable use. Any such compound which can be vaporized (or volatized) at a relatively low temperature and without harmful degradation products can be suitable for use with a cartridge or device of the invention. Examples of compounds include, but are not limited to, menthol, caffeine, taurine, and nicotine.

Active elements contained in botanicals vaporize at different temperatures. The device can be calibrated to establish a single stable temperature, intended for vaporizing specific products, for example. A controller can also be used to select a variety of temperature settings. The user would choose which setting based on the type of cartridge used. The controller can also affect a desired temperature mechanically, such as by changing flow rate of the valve, or electronically, such as by electromechanical valve and micro-controller intermediary. For example, to change the operating temperature of a device of the invention, the oven chamber can be moved in respect to the temperature regulator, such as bimetallic discs.

Here, tobacco or tobacco material is defined as any combination of natural and synthetic material that can be vaporized for pleasure or medicinal use. In one embodiment of the present invention, a cartridge can be prepared using cured tobacco, glycerin, and flavorings. Those skilled in the art of tobacco product manufacture are familiar with these and other ingredients used for cigarettes, cigars, and the like. The cartridge can be produced by chopping tobacco into fine pieces (for example, less than 2 mm diameter, preferably less than 1 mm), adding the other ingredients, and mixing until even consistency was achieved. In another embodiment, a cartridge can be prepared by processing the fill material into an even paste-like consistency (for example, particle size less than 1 mm), which facilitates the processing of filling the cartridge, for example, by use of an auger filler, peristaltic pump or a piston pump.

Preferably the material for use with a device of the invention or contained within a cartridge of the invention comprises at least one of a vapor-forming medium and a medium for providing a tactile response in a respiratory tract of a user. The aerosolized product from the material inserted into a device can be a combination of vapor phase gases as well as small droplets which have condensed out of vapor phase and remain suspended in the gas/air mixture (the latter constitutes the visible portion of the inhaled substance).

Propylene glycol (PG), glycerin, or a combination of both can be used as vapor-forming medium. Other vapor-forming media can be used with a cartridge and device of the invention. The vapor-forming medium serves to produce a visual vapor, such as a smoke-like vapor, when heated. This vapor can be visualized both before inhalation and during exhalation of the medium. PG has some advantages as compared to glycerin alone, as it exhibits a much higher vapor pressure at equivalent temperature and allows the device to operate at a lower temperature. Reducing the operating temperature conserves energy, and potentially can further improve the health benefits of using this system.

Output: LED Lights

Upon entering the entertainment mode, as discussed above, the device may present a display (output display) and/or provide an interactive game. Many of the variations described herein operate an output including a plurality of LEDs. Other or additional displays may be used, including a screen (touchscreen, etc.).

Figure 2:
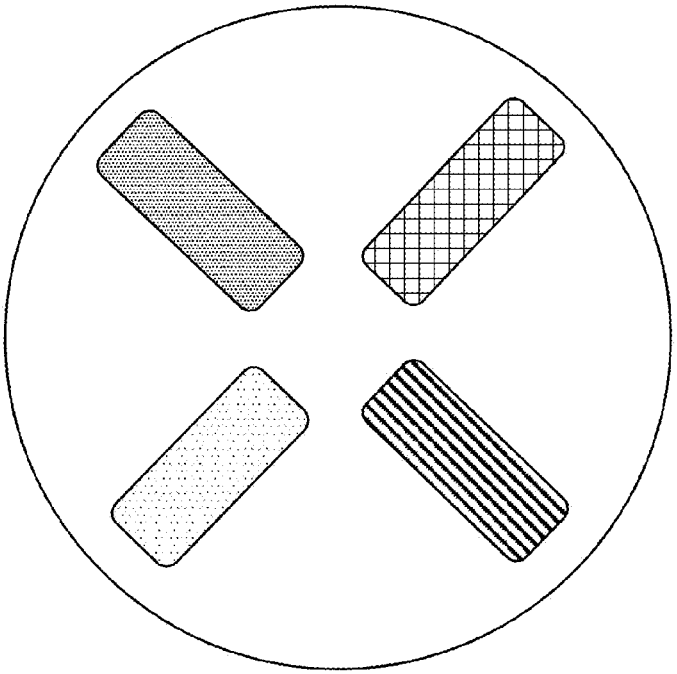
FIG. 2 shows an enlarged view of the series of LED lights blown up where the different patterns indicate a different color displayed.
Figure 1D:
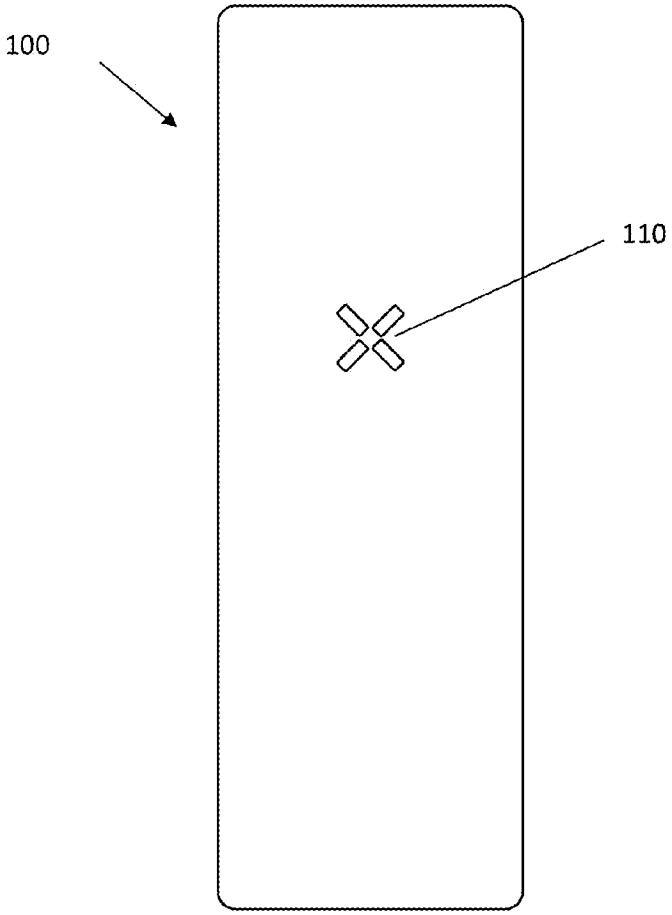
FIG. 1D is a front view of the vaporization device of FIGS. 1A and 1B, showing a series of four LED lights.
Figure 3A:
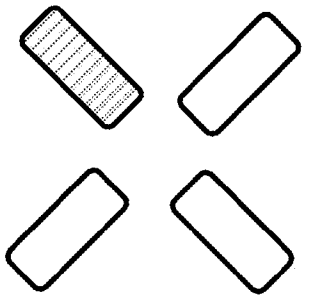
FIGS. 3A-3D show the series of four LED lights where the same color LED light may be displayed on any of the individual LED lights.
Figure 3B:
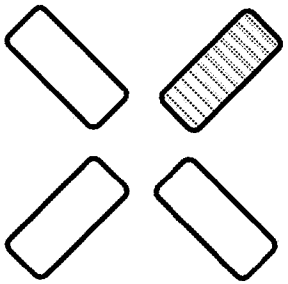
Figure 3C:
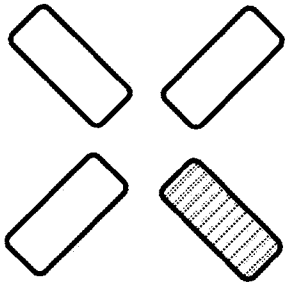
Figure 3D:
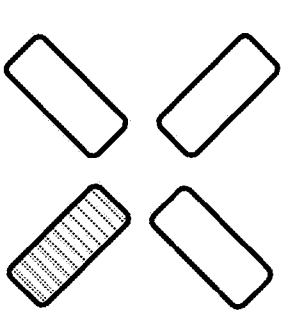
Figure 4A:
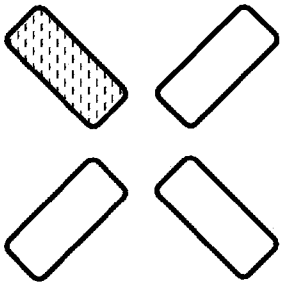
FIGS. 4A-4D show the series of four LED lights where the same color LED light may be lit for one, two, three, or four of the individual LED lights.
Figure 4B:
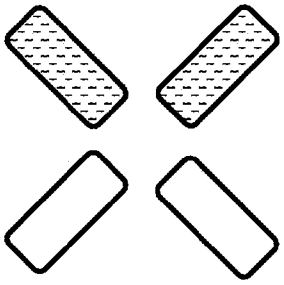
Figure 4C:
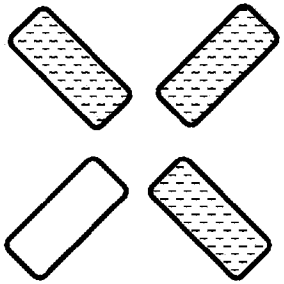
Figure 4D:
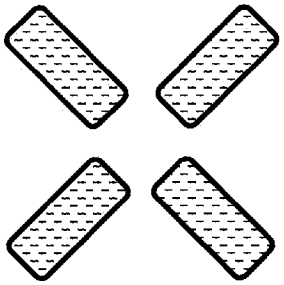
Figure 5A:
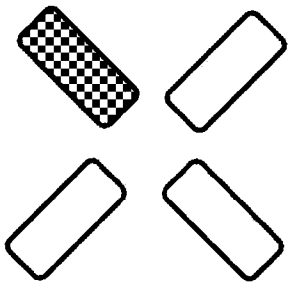
FIGS. 5A-5D show each individual LED light may display a different color LED in a pattern.
Figure 5B:
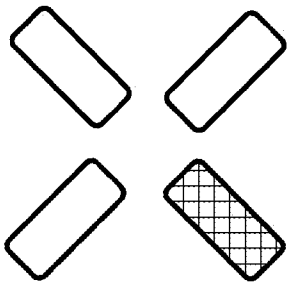
Figure 5C:
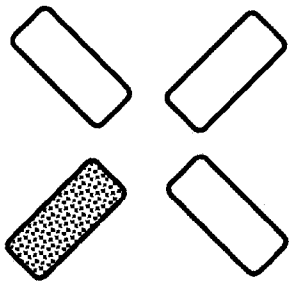
Figure 5D:
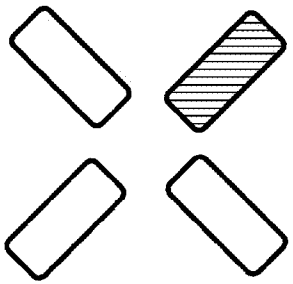
Figure 6A:
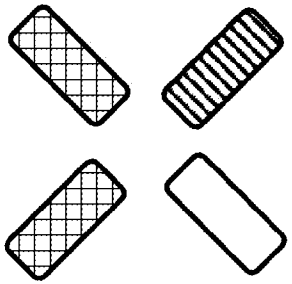
FIGS. 6A-6D show each individual LED light may display more than on color, one color, or no color for any particular sequence.
Figure 6B:
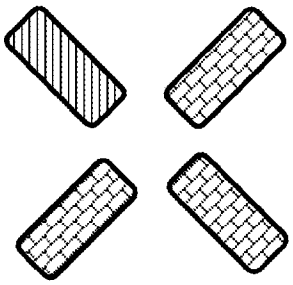
Figure 6C:
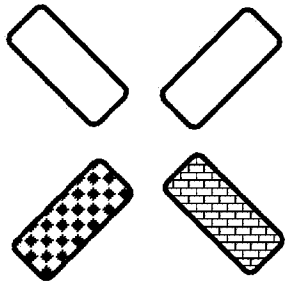
Figure 6D:
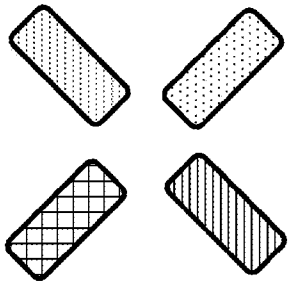

As mentioned, an exemplary vaporization device 100 is shown in FIGS. 1A-1D. This example includes a plurality of LEDs arranged as an LED light display window 110 on the outer surface of the vaporization device 100. In some embodiments, the LED indicators are tri-color (RGB) LEDs. In some embodiments, the LED indicator displays many colors (as shown in FIG. 2). In FIG. 2, the different patterns in each of the LED light windows indicate a different color. For example, when heating, the indicator glows purple. Once the set point temperature is reached, it glows green. When in standby, it glows blue. If the device is shaken, battery indications are 3 blinks, and color determines the charge level: green for full charge, yellow for partial, and red for low. If the mouthpiece is removed fully from the device, the device immediately stops heating and the LED indicates the current user-selectable temperature setting: red for high, orange for medium, yellow for low temperature. Pressing the "temp set button" revealed by removing the mouthpiece cycles the temperature setting in firmware, and the new setting is reflected on the LED. Upon reinserting the mouthpiece, the device returns to normal heating operation. While charging, the LED is solid orange. When charging is complete, it turns solid green. Similar to the other embodiments, the LED can also report error states by flashing and/or distinct color of flashes. The colors described above may be changed to any colors in accordance with the practice of this invention.

FIGS. 3A-6D show some exemplary LED light display patterns. FIGS. 3A-3D show how the same color may be cycled through in either a clockwise or counterclockwise manner. The same color light may also be displayed in a random sequence on the four segments of the LED light display window. FIGS. 4A-4D show that a single color may light up one, two, three, or all four of the segments of the LED light display window. FIGS. 5A-5D show that the LED lights displayed may be a sequence of lights displayed on any of the four segments of the LED light display window and the colors may be all the same, all different, or where some colors are repeated while others are not displayed at all. Finally FIGS. 6A-6D show that the four different segments of the LED light display window may show a variety of combinations of lights, where some or all of the LED light segments are lit. In some instances, the color lights displayed on the four different segments of the LED light display window may be all different or partially the same.

Entertainment Mode

As mentioned above, upon entering the entertainment mode, as discussed above, the device may present a display (output display) and/or provide an interactive game.

The entertainment mode may also be referred to as an enhanced experience mode. This entertainment mode may allow for increased pleasure or social interactions while using the vaporization device. The entertainment modes are intended to be enjoyed while using the vaporization device. The inputs, e.g., sensors such as motion sensors or accelerometers that are able to capture various movements to the device, may be used to provide interactive experiences (games and displays) in the entertainment mode.

In some instances, a user may place the device in the entertainment mode by manipulating the device in an ordered sequence, as shown and described in FIG. 1B. For example, the ordered sequence may include shaking the device in a certain direction, flipping the device about its long or short axis a predetermined amount of times in a clockwise or counterclockwise direction, e.g., holding the device horizontally and spinning it three times in one direction or in the opposite direction changes the mode of the device.

One example of an entertainment mode is a party mode. In the party mode, all of the LED lights may light up. The LED lights may be of different colors and cycle through different colors in a certain order. In some instances, placement of the lips on the mouth piece activates the lip sensor and increases the rate at which the colors are cycled through. Furthermore, while in the party mode, the oven remains on and the standby timer length is increased between sensing movement and sensing the lips.

Included with the party mode is a party timer mode. While the device is in the party time mode, all for LED lights may be on and stationary, or in another set configuration. When the device senses movement, the LED lights may begin to jump a random light configuration. In some instances, one or more of the LED lights may dim or turn off while others remain on. In other instances, when the device placed in a certain orientation (e.g. face down), the rate at which the lights flicker may increase or decrease. In this state, if the lip sensor detects sufficient contact, the LED may change its rate or flicker for a set amount of time. After the lip sensor senses activation for a set amount of time (e.g. 10 seconds), the LED lights may again change its appearance (e.g. lights freeze and remain on) as the oven is turned on. In some instances, the oven may already be on. If the lip sensor senses no contact followed by sensing lip contact may start another time counter for placing switching the device between standby and active modes.

Another mode that is included in the party mode is a light cycling mode. In this mode, all four LED lights display the same color cycle through different colors while the device is being moved. When the device senses no movement, the LED lights may turn off. The LED lights may be made to cycle through a stream of changing colors by moving the device in a predetermined fashion (e.g. waving the device).

The device described herein may also show a carousel of colors. The LED lights displayed on the outer surface of the device. For example, when the device is laid down in a flat position, the device may display a certain color. If it turned on its sides, a different color or colors may be displayed. The LED lights on the device may also display another color patterns when the device is held in an upright position or if it in a tilted orientation. In these different orientations, the LED lights may appear to flash all one color light, the lights may show a cycle of a particular color sequence, the LED lights may all blink one color, LED lights may only have some of the lights blink while others are off or some of the lights blink while the others stay on, or where some of the LED lights are either on, blinking one color, or blinking a sequence of colors.

The device may contain other features of the entertainment mode, such as tunes that may go along with the changing LED lights. For example, after performing a sequence of manipulating the orientation of the device, not only would the LED lights on the device change color, but a recognizable clip of a tune may be heard emanating from the device. In some instances, the tune clip may be generated by piggybacking on the sounds that may be already produced from the oven changing its temperature or from the device circuitry itself, without the need for an additional or dedicated speaker (e.g., by changing voltages applied to capacitive elements in the control circuitry to produce a series of vibrations/tones).

Games

The enhanced experience mode of the device may also include game modes. For example, a user may unlock the game mode on the device by either a series of movements to the device alone or in combination with playing their lips to the mouthpiece.

A user may play a game similar to a Simon says type or other memory-type game. The user may place the device in this particular game mode by a series of movements to the device such as rotating the device twice in a clockwise manner along the device's long axis followed by three rotations in a counterclockwise manner. The device may convey to the user that they are in a particular game mode through a special LED light pattern of color or colors (e.g. all four LEDs lighting up white for a predetermined amount of time). After placing the device in this particular game mode, the memory type game will begin, where different colors light up at any one of the LED light windows. The user would then follow the pattern of lights either by tilting the device in the direction of the light or covering up the LED light window. Once the user has completed the sequence, the device will register this, and a new sequence of patterns will appear for the user to follow. As the user successfully mimics the pattern that the device outputs, the sequence pattern may become more complex or the pattern may come a faster pace. A Simon says version of this game may have a tone associated with the pattern that the user is invited to copy and as the pace of the sequences becomes faster, the tone may disappear or change for some of the sequences displayed, where the user are supposed to refrain from following the pattern. Play continues until the user either fails to correctly follow the outputted sequence of patterns or the user follows a pattern that did not have a corresponding set of tones.

Another example of a game that may be unlocked within the device is a pursuit game. Similar to the memory or Simon says game, the user may unlock the game using a sequence of predetermined rotations, tilts, or other orientation manipulation of the device. Once registered, the device will show a set pattern on the LED light display for a number of seconds to indicate that the game has been implemented. In this game, the user is designated a certain first color, and must avoid a chaser light, designated with a second color by tilting or moving the device. Another object of this would is the user must attempt to capture certain third color lights on the LED light display as they show up to gain sufficient energy while simultaneously trying to avoid the chaser light. The third color light that represents energy may be captures if the first light moves onto the particular LED light display window segment at or under a preset amount of time. Once the user has captured enough energy, the user's color changes in some way (e.g. becomes brighter) to indicate that the roles have now been reversed and the user's light may chase the chaser light around the LED light display. The user's LED light has a set amount of time to attempt to capture the chaser light at which time the roles revert back to the user's color light being chased by the chaser color light about the LED display. This order of play continues until the user's LED is captured or the user's LED light captures the chaser light. In some instances, there may be restrictions on how the light may travel about the LED light display window segments.

Yet another example of a game that may be unlocked within the device is a containment-type game. Similar to the games described above, this game may be unlocked using yet another series of manipulations to the device, e.g., within entertainment mode. The containment game involves the user attempting to contain a certain color of LED light within a bounded area by tilting the device in various angles. The user must prevent the certain LED color from a predefined border within the LED lights display window.

Another game that may be played on the device may be played by multiple persons. This chance game involves the players to cast votes on what colors will be displayed in the LED window. Once votes have been cast, a certain action on the device (e.g. a flick of the device) will cause the device to display a series of colors in the LED display. The colors may be singularly displayed or occur more than once. The player that comes closest to guessing the actual pattern displayed wins. Multiple devices may interact via the wireless connectivity, as mentioned above.

In each of the games described above, when the user "wins", a certain light pattern may be displayed. In some other instances, a musical clip may also play in conjunction with the light displayed to indicate that the user has won. Alternatively, a second sequence of audio chords may play when a user loses a game.

Figure 7B:
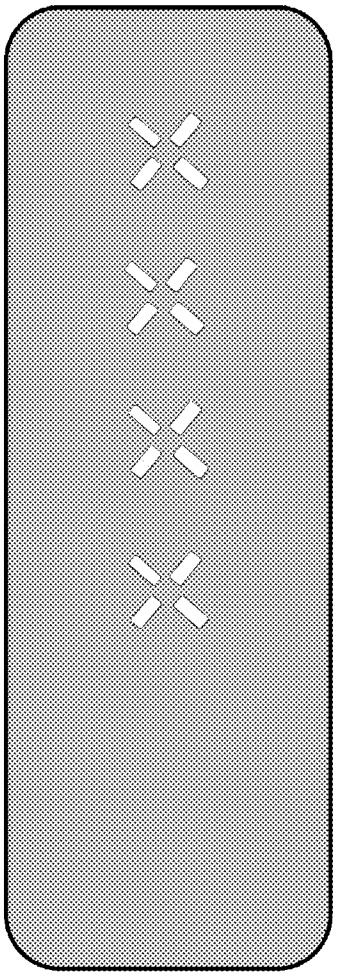
FIGS. 7A and 7B show alternative arrangements of the LED light display window.
Figure 7A:
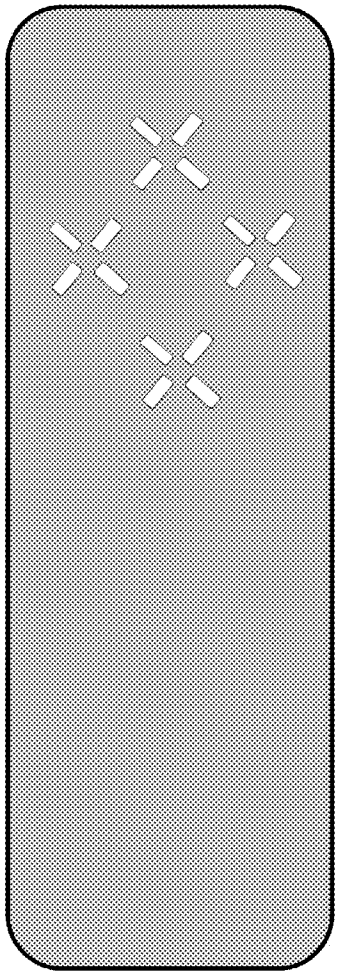
Figure 8:
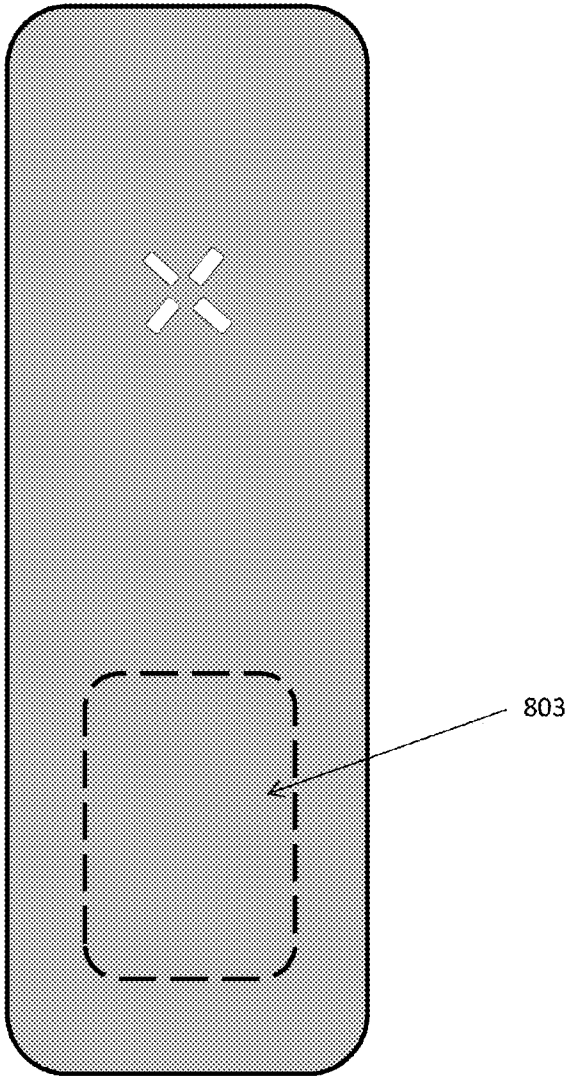
FIG. 8 shows the vaporization device having a touchpad.

In other embodiments of the entertainment mode, there may be other features that may be incorporated into the vaporization device that may increase the enjoyment of those using the device. For example, a more intricate pattern of LED light windows may be configured on the vaporization device as can be seen in FIGS. 7A and 7B. There may be more than one set of the original LED light windows disposed on the outer surface of the device that are arranged various patterns. Having more LED light display sets disposed on the outer surface of the device increases the potential for interactive games that may be implemented on the device for the user's enjoyment. In other examples, the device may incorporate a touch pad on the outer surface of the device that may be able to control the lights and the pattern that is displayed in the LED light display windows as shown in FIG. 8. The touchpad 803 in FIG. 8 is the area defined by the dotted line. Having a touchpad may allow the user to more easily manipulate the LED color display when the device is in an enhanced-experience or game mode. In some examples, the user may use such a touchpad to generate tones that may be linked to colors displayed on the LED light display window.

Figure 9:
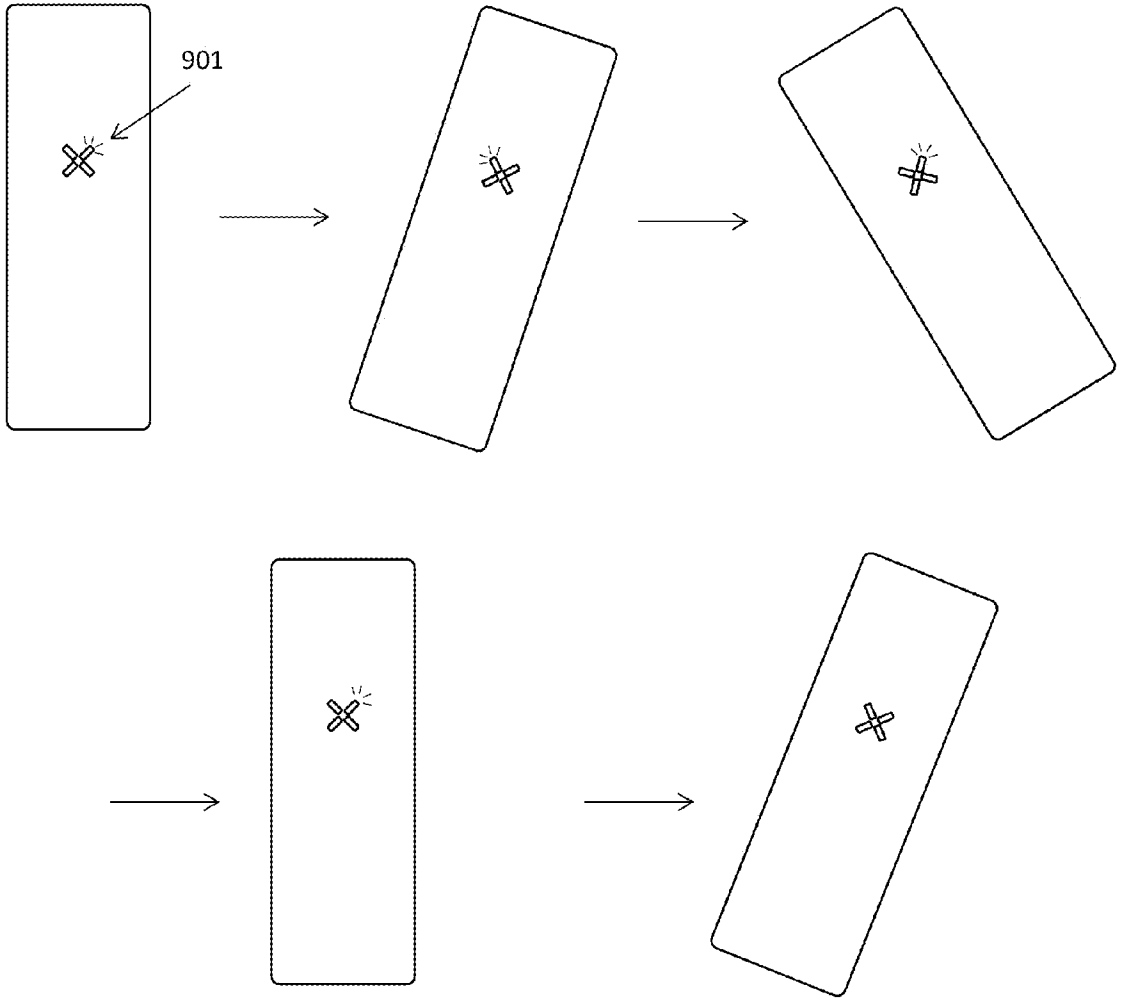
FIG. 9 illustrates one example of a game (e.g., a pattern-following game) as described herein.

FIG. 9 illustrates another example of a game (e.g., a pattern-following game) in which one of the plurality of LEDs lights up 901 with a different color and the user must tilt or move the device in that direction, following the pattern of changing lights as shown.

Table 1 (FIG. 10) illustrates example of different games and displays that may be accessed in the entertainment modes described herein. Additional games and/or displays may also be included. In general, other device states are illustrated and described in Table 2 (FIG. 11).

EXAMPLE

FIGS. 12A-13B illustrate another example of an apparatus (e.g., vaporizer apparatus) including the features described herein. In this example the vaporization device 400 includes a heater 433 (including wick and coil in this example, though other variations may include an oven or may be coupled to an oven). The heater is configured to vaporize a vaporizable material. The device also includes an output on the device. In FIGS. 12A-13B the output is an array of LED lights 499 that are on the reusable elongate body and visible through the shell. The device also includes one or more input in/on the device configured to be manipulated by a user. In this example the input may be an accelerometer 489 that is housed within the shell, a lip sensing input, a contact input, or the like. Any of these devices may also include a controller adapted to regulate the temperature of the heater. The controller comprises a normal mode and an entertainment mode comprising one or more games configured to be played using the input and output.

Figure 13A:
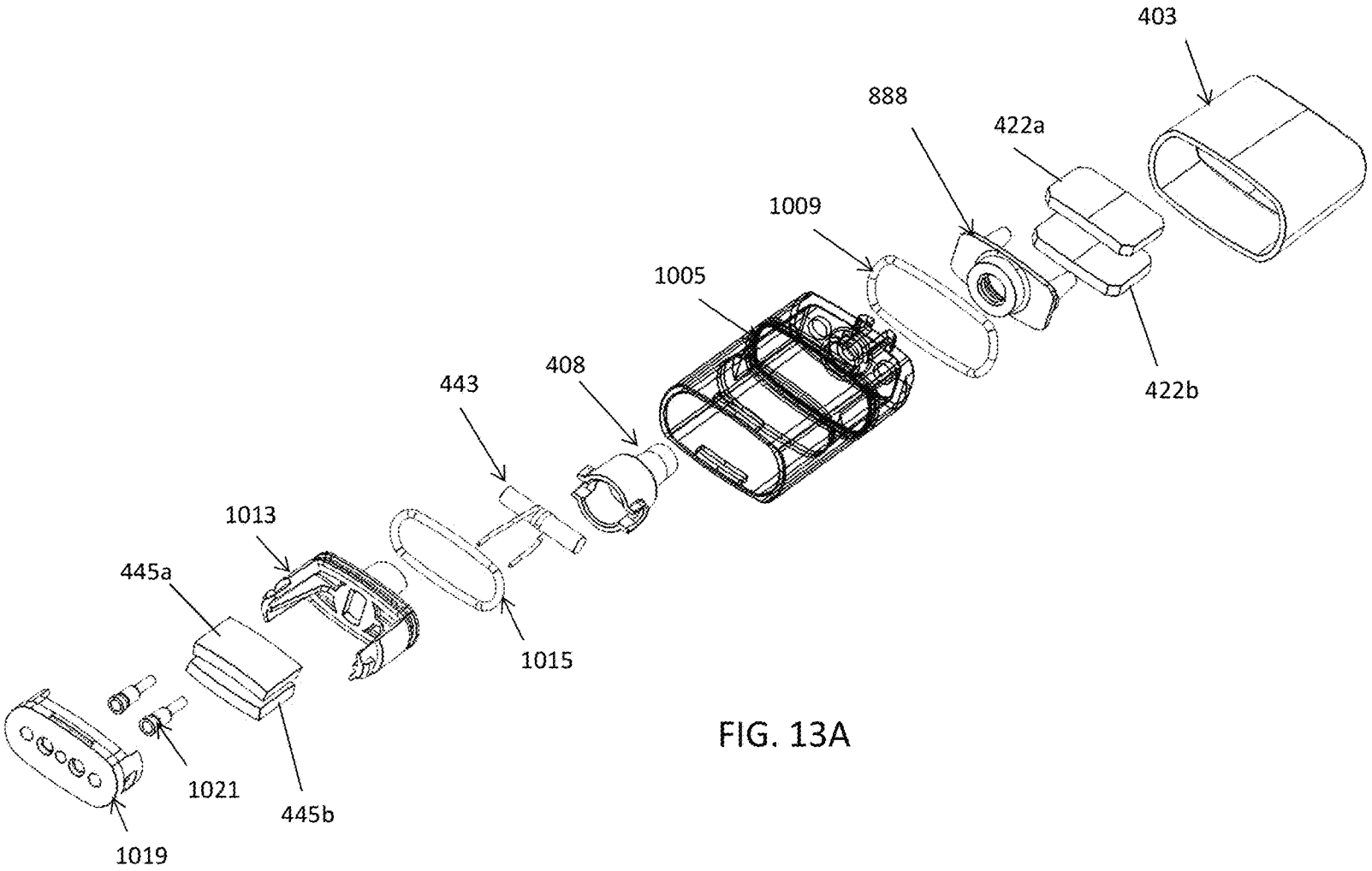
FIG. 13A is an exploded view of the cartridge of FIGS. 12A and 12B with the components arranged in line.

In the example shown, the apparatus includes a cartridge that may house the vaproziable material and the heater. FIG. 13A shows an exploded view of a cartridge. In this example, the cartridge has a cartridge body 1005 that may be clear (transparent), opaque and/or translucent. The cartridge body may form a reservoir for the liquid vaporizable material, and particularly for a viscous liquid vaporizable material such as a cannabinoid oil. The cartridge may include an outer seal (e.g., o-ring 1009) that seals the mouthpiece 403 over the body 1005. The reservoir (tank) may be sealed on the top (at the proximal end) under the mouthpiece by a single-piece plug 888 that covers multiple openings which may be used for filling the tank. The vaporization chamber may be formed at the bottom (distal end) of the cartridge; the vaporization chamber may be formed from a cannula and housing piece 1011 that includes opening into which the wick (wick portion of wick and coil, forming the heater 443) passes into the chamber; the walls forming the vaporization chamber separate it from the tank and mate with a back piece 1013 that forms the bottom (distal end) of the tank within the cartridge body. This piece is also sealed (e.g., by an o-ring 1015) to the cartridge body from within the cartridge body, as shown. An air chamber is then formed between the bottom of the cartridge 1019 and the back piece 1013 of the tank. One or more (e.g., two) air openings 796, 796' through this bottom 1019 allow air to pass (after entering the cartridge receiver through one or more openings 894 in the side) into the distal end of the cartridge, into the air chamber region and then up through an opening into the vaporization chamber. The piece forming the bottom of the cartridge 1019 may also accommodate or include one or more (e.g., two) electrical connectors that are configured to mate with the connectors on the vaporizer base. These contacts may be wiper or scraping contacts. In FIG. 13A they are shown as cans 1021, 1021' having openings into which the pins project to form an electrical contact.

The vaporizer (reusable) body typically includes a battery and one or more control circuits housed within the cover 890. The control circuitry may control the heater, which in this example, is present in the cartridge. The heater in this example includes a heating coil (resistive heater) in thermal contact with the wick; additional connectors formed of a different material (e.g., conductive material) may connect the heater coil to the electrical contacts on the base of the cartridge; although this may lead to inaccuracies in detecting and controlling temperature electrically, as described below, the control circuitry may include one or more additional circuits, such as Seebeck measurement circuits, that correct for offsets and other inaccuracies in the determination of temperature and therefore the power applied to the apparatus. The control circuitry may also include and may control and/or communicate with a batter regulator (which may regulate the battery output, regulate charging/discharging of the battery, and may provide alerts to indicate when the battery charge is low, etc.). The control circuitry may also include and may control and/or communicate with an output, such as a display, one or more LEDs, one or more LCDS, a haptic output, or any combination of these. In this example the apparatus includes only four (RGB) LEDs 897, arranged in a pattern (e.g., a circular, spiral or floral pattern; other patterns may include linear patterns). Any of the apparatuses described herein may also include a wireless communication circuity that is part of, connected and/or controlled by the control circuitry. The apparatus may be configured to wireless communicate with a remote processor (e.g., smartphone, pad, wearable electronics, etc.); thus the apparatus may receive control information (e.g., for setting temperature, resetting a dose counter, etc.) and/or output information (dose information, operational information, error information, temperature setting information, charge/battery information, etc.).

The apparatus may also include one or more inputs, such as an accelerometer, a lip sensing input, a contact input, or the like. In particular, described herein are vaporizer apparatuses in which the device does not include any visible buttons, switches or external user input on an outer surface of the cartridge or vaporizer base. Instead, the input may be an accelerometer (coupled to, part of, and/or controlled by the control circuitry). The accelerometer and any accelerometer control circuitry may be configured to detect tapping on the apparatus (e.g., the case) and/or rolling of the apparatus (e.g., around the long axis or the short axis of the device). In some variations the apparatus may also include circuitry for sensing/detecting when a cartridge is connected and/or removed from the vaporizer base. For example, cartridge-detection circuitry may determine when a cartridge is connected to the device based on an electrical state of the electrical contacts within the cartridge reliever in the vaporizer base. Without a cartridge inserted into the apparatus the circuit may be open and with the cartridge inserted, the electrical contacts engage with the contacts (such as wiping contracts, described above, which scrape to remove leaked and/or dried vaporizable material on the electrode contact surfaces). The controller (via a separate or integrated cartridge-detection circuit) may determine that a cartridge has been inserted when the resistance between these contacts changes to within a recognizable range (from the open circuit). Other cartridge detectors may be used alternatively or additionally, including a trip switch (which is activated when the cartridge is present), or the like. Any of the apparatuses described herein may also include one or more breath detectors, including a pressure sensor (e.g., microphone coil) having a connection to the inside of the cartridge receiver.

The vaporizer body may also include a connector 899 at the distal end for coupling the device to a charger and/or data connection. The internal battery may be charged when coupling the device to a connector; alternatively other electrical connectors and/or inductive charging may be used.

Figure 12A:
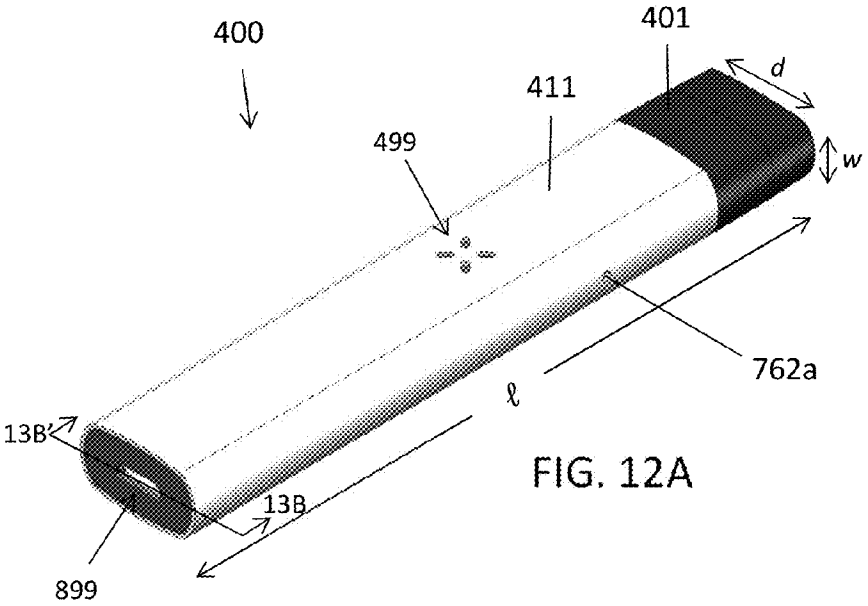
FIGS. 12A and 12B show an exemplary vaporization device that may be used with any of the methods and apparatuses described herein. This exemplary device includes a visual output 499 (shown as an array of LEDs formed by openings through the outer shell).
Figure 12B:
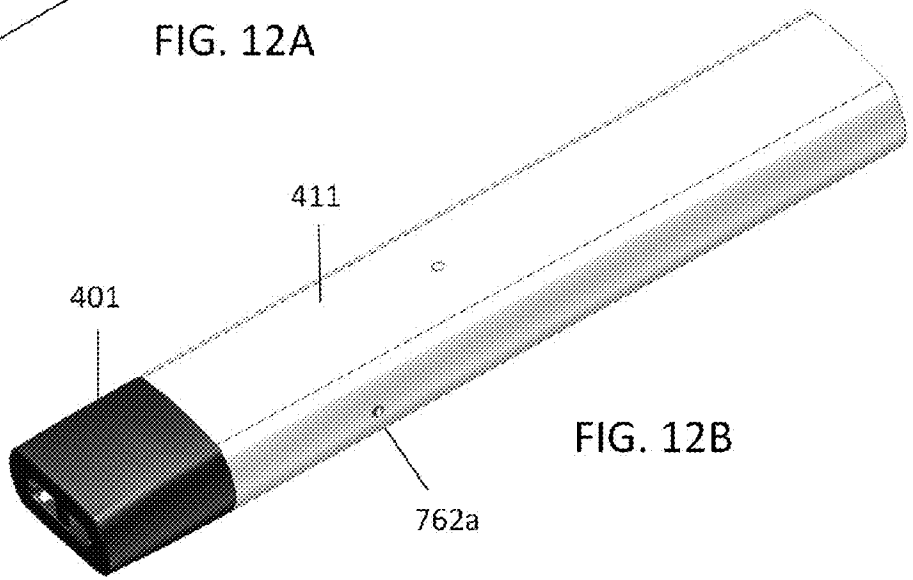

In the exemplary vaporizer 400 in FIGS. 12A-13B. As shown in FIGS. 12A-12B, the vaporizer 400 includes a reusable component 411 and a cartridge 401. The diameter of device 400 is greater than the width (e.g., greater than 1.2×, 1.3×, 1.4×, 1.5×, 1.6×, 1.7×, 1.8× 1.9×, etc.), making the device have a substantially long and flat appearance and feel. The reusable component 411 includes a shell 431, which can include the electronics for operating the vaporizer. Further, the reusable component 411 can include a visual indicator 421, such as an LED, for signaling the operating status of the vaporizer 400 and as an output for the games, as described herein. The distal end of the reusable component 411 may include a charging element 899 configured for charging the device. Further, the proximal end of the device may include contacts for maintaining an electrical connection with the cartridge 401.

The cartridge includes a tank 441 configured to hold a liquid vaporizable material therein, a heater (e.g. a wick and coil assembly) 443 configured to heat the vaporizable material in the tank 441, and an air tube 408 extending from the tank to a mouthpiece 403. Contacts are configured to connect with contacts on the reusable component 411 to provide power to activate the wick and coil assembly 443. At the distal end of the cartridge the walls of the elongate and flattened tubular body 441 and a bottom cover piece form an overflow leak chamber, which is shown with a pair of absorbent pads 445*a,b* are positioned along the long walls (along the diameter) of the overflow leak chamber. An option felt cover may be included (also acting as an absorbent member).

Figure 13B:
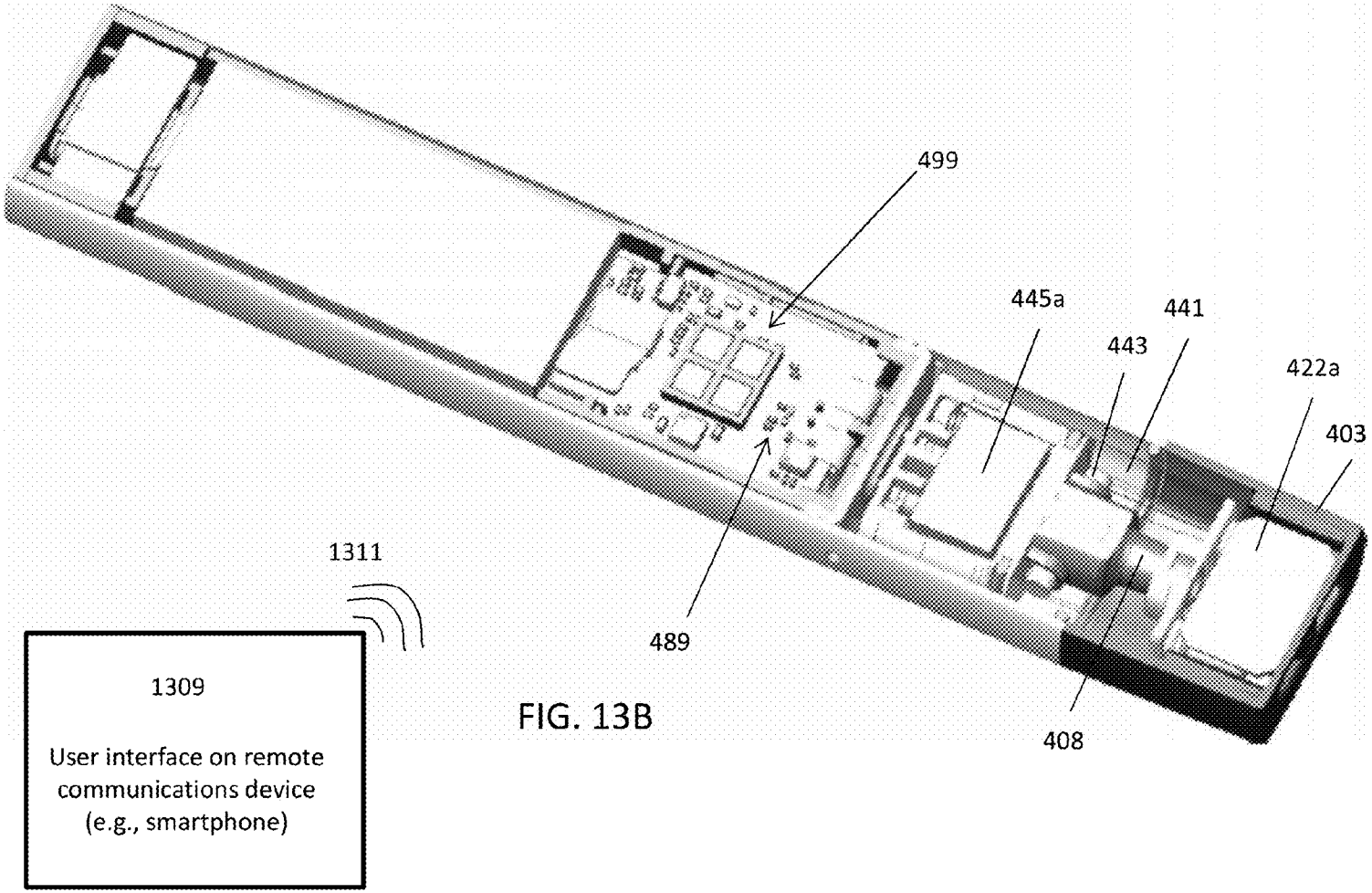
FIG. 13B shows another section through the assembled vaporizer apparatus (through line 13B-13B' in FIG. 12A.

As shown in FIG. 12A the device 400 further includes openings, configured as air inlets 762*a,b*, on the side of the shell 431. The air inlets are proximate to openings (air inlets) on the distal end of the cartridge 401 opening into the overflow leak chamber (not visible). Referring to FIG. 13B (which is a cross-section of the device 400 near the center), the air flow path extends through the tube until it reaches the stop and then divides into two separate paths that extend along the inner surface of the mouthpiece (between the pads 422*a,b*) and out through the outlets of the mouthpiece 403.

Parallel absorbent pads 422*a,b* can be positioned within the mouthpiece 403. The absorbent pads 422*a,b* are rectangular and parallel with one another. In some embodiments, over-flow pads 445*a,b* are positioned proximate to the tank 441, i.e., within an overflow leak chamber below the tank, to absorb liquid that may leak out of the tank 441 during use. The over-flow pads 445*a,b* can be similarly placed parallel to one another and/or against the sides of the shell 431 as described above with respect to pads 422*a,b*.

In use (i.e., when the user draws on the device), the device 400 can be held horizontally with the width, w, in the vertical direction and the diameter, d, in the horizontal direction.

Any of the devices described herein may wired or wirelessly (e.g., Bluetooth, Wifi, etc.) communicate with a remote device such as a smartphone running an operating system. The games may be activated (initiated) and/or controlled remotely. For example, an application software program may be used to select and being playing a game using the vaporizer device. The application software may be updated or modified to modify games on the device.

Any of the methods (including user interfaces) described herein may be implemented as software, hardware or firmware, and may be described as a non-transitory computer-readable storage medium storing a set of instructions capable of being executed by a processor (e.g., computer, tablet, smartphone, etc.), that when executed by the processor causes the processor to control perform any of the steps, including but not limited to: displaying, communicating with the user, analyzing, modifying parameters (including timing, frequency, intensity, etc.), determining, alerting, or the like.

For example, an apparatus such as that shown in FIGS. 12A-13B may be held horizontally and smoothly rolled (e.g., three or more times) or a game may be selected with the app to temporarily put the device into game mode. The user can exit game mode by turning the device off or deselecting the selected game shown on the app (e.g., tapping the selected game to deselect on the user interface). When game mode is active, the device's LEDs may show the game you've selected instead of showing heating state or charging. When game mode is active, an additional temperature selection, "Oven Off," may be available through temp set mode on the device. The Oven Off temperature selection may be shown as four blue LED petals after all other temperature selections when cycling through selections in temp set mode. The Oven Off selection may be provided when games are active to allow you to play games without wasting your oven material or significant battery life. Other than the addition of Oven Off, temp set mode may work the same in game mode as it does when the apparatus is not in game mode. Example games may include a "run" game, a "simpon-says" type game, and/or a "spin" type game. A run or says game may automatically select Oven Off to avoid wasting the oven material (vaporizable material).

A game may also be played while vaping. For example, entering a game mode (e.g., for the spin type game) may automatically exit Oven Off and return to your last temp selection if Oven Off was selected, though Oven Off may still be available in temp set mode. For example, the battery level display may be disabled in some game modes (which may otherwise be available by shaking the device) as playing some of the games may involve shaking the device.

In one example, a user may test their reflexes with a four-pixel game of cat and mouse. The user may be a selected color or pattern of LEDs (e.g., a yellow colored petal). Holding the device flat with LEDs facing up, the apparatus may be tilted to control game movements, and the user may avoid other objects (other colored petals) until a "power up" (e.g., a white petal) is contacted. A power up may last for a short period (e.g., 3 s), indicated by the other objects turning a different color (e.g., dark blue and pulsing dark blue towards the end of the power up). Eating these objects during this period may advance the user to the next level. These objects ("ghosties") may move faster on each level. A player may start with five lives and may get another life for every fourth ghostly they "eat," indicated by a colored blink for every four ghosties eaten so far (e.g. 2 ghosty-colored blinks means you just beat level 8 and got another life). A device may blink all four petals yellow once for every life you have left after losing a life. Losing all your lives may restart the game. Entering temp set mode or exiting the game (manually or using the app) may pause the game.

As mentioned above, any of these devices may include a memory game. The apparatus may pulse different colors (e.g., the four colors in a clockwise swirl to indicate game entry); a round in the game may consist of the device lighting up three or more petals (one at a time, in variations in which the LEDs are arranged as "petals" as discussed above; other arrangements/shapes of LEDs may also/alternatively be used) in a random sequence, after which the user must reproduce that sequence by holding the apparatus level with the ground (lights facing up) and then tilting the device so that the petal they want to light goes down (it's as if you're pushing down on the petal you want to light). LEDs may pulse white if the user does this correctly. LEDs may pulse Red after the first incorrect entry. The game may start with a random sequence of three petals (level 3). A petal is added to the sequence every time the user correctly reproduces the sequence generated by the device. Turning the device off and on may restart the game. Entering temp set mode or exiting the game may pause.

A spinning game may be played by the user making a single shake left or right to send the brightest petal spinning at a speed based on the max acceleration seen. The spinning petals may slow down and stop in a pseudo-random position. A user can use position of the stopped brightest petal in any number of homemade games, e.g. stopped petal points to the person who gets to hit the apparatus next. Any of the other exemplary games and apparatuses described herein may also be used.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co-jointly employed in the methods and articles (e.g., compositions and apparatuses including device and methods). For example, the term "comprising" will be understood to imply the inclusion of any stated elements or steps but not the exclusion of any other elements or steps.

In general, any of the apparatuses and methods described herein should be understood to be inclusive, but all or a sub-set of the components and/or steps may alternatively be exclusive, and may be expressed as "consisting of" or alternatively "consisting essentially of" the various components, steps, sub-components or sub-steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A vaporization system comprising:

a vaporizer device comprising a heater configured to vaporize a vaporizable material, an output, an input configured to enable manipulation by a user, and a controller configured to control a temperature of the heater, wherein the controller is configured to activate an entertainment mode of the vaporizer device, the entertainment mode comprising one or more games configured to be played using the input and/or the output, the one or more games comprising a memory game configured to display an output sequence on the output and compare the output sequence with an input sequence.

2. The vaporization system of claim 1, wherein the output comprises a sound output and/or a vibrational output.

3. The vaporization system of claim 1, wherein the output comprises a plurality of LEDS.

4. The vaporization system of claim 1, wherein the input comprises a button, a capacitive sensor configured to detect skin contact with the vaporizer device, and/or a motion detector configured to detect movement of the vaporizer device.

5. The vaporization system of claim 1, wherein the input comprises a motion detector configured to detect movement of the vaporizer device.

6. The vaporization system of claim 1, wherein the controller is configured to maintain the temperature of the heater at a vaporization temperature for a longer time when the vaporizer device is in the entertainment mode compared to a normal mode.

7. The vaporization system of claim 1, wherein the controller is configured to enter a standby mode after a predetermined time period during which the input is not activated, wherein the controller is configured to reduce the temperature of the heater by a predetermined amount when in the standby mode.

8. The vaporization system of claim 1, wherein the entertainment mode comprises an entertainment output that is triggered upon entering into the entertainment mode, the entertainment output comprising a display of a plurality of colors and/or patterns on the output, a tone or series of tones, and/or a vibration or series of vibrations.

9. The vaporization system of claim 1, further comprising:

a user interface of a mobile device in communication with the vaporizer device, the user interface configured to control the entertainment mode.

10. The vaporization system of claim 1, wherein the input sequence is provided by the user through the input.

* * * * *